US008412076B2

(12) United States Patent
Murasaki et al.

(10) Patent No.: US 8,412,076 B2
(45) Date of Patent: Apr. 2, 2013

(54) IMAGE FORMING APPARATUS

(75) Inventors: Satoshi Murasaki, Suntou-gun (JP); Toshifumi Kitamura, Numazu (JP); Yasuhisa Matsumoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 451 days.

(21) Appl. No.: 12/730,499

(22) Filed: Mar. 24, 2010

(65) Prior Publication Data

US 2010/0316413 A1 Dec. 16, 2010

(30) Foreign Application Priority Data

Jun. 12, 2009 (JP) ..... 2009-141391
Feb. 5, 2010 (JP) ..... 2010-024604

(51) Int. Cl.
*G03G 15/01* (2006.01)
*G03G 15/04* (2006.01)

(52) U.S. Cl. ..... 399/228; 399/119

(58) Field of Classification Search ..... 399/119, 399/228

See application file for complete search history.

(56) References Cited

U.S. PATENT DOCUMENTS

| | | | | |
|---|---|---|---|---|
| 5,412,457 | A * | 5/1995 | Kawano et al. | 399/228 |
| 6,795,671 | B2 * | 9/2004 | Matsuoka | 399/223 |
| 7,787,805 | B2 * | 8/2010 | Kamimura | 399/228 |
| 7,986,906 | B2 * | 7/2011 | Okabe et al. | 399/228 |
| 2005/0069347 | A1 * | 3/2005 | Okabe | 399/228 |
| 2005/0163519 | A1 * | 7/2005 | Takahashi | 399/49 |
| 2006/0177230 | A1 * | 8/2006 | Ishii | 399/12 |
| 2006/0216061 | A1 * | 9/2006 | Yamaguchi | 399/111 |
| 2006/0245785 | A1 * | 11/2006 | Kawamura et al. | 399/111 |
| 2007/0077087 | A1 * | 4/2007 | Okabe et al. | 399/111 |
| 2010/0124427 | A1 * | 5/2010 | Sugiyama | 399/53 |

FOREIGN PATENT DOCUMENTS

| | | | |
|---|---|---|---|
| JP | 2004020855 | A * | 1/2004 |
| JP | 2006-292868 | | 10/2006 |
| JP | 2007-293218 | | 11/2007 |

* cited by examiner

*Primary Examiner* — Walter L Lindsay, Jr.
*Assistant Examiner* — David Bolduc
(74) *Attorney, Agent, or Firm* — Canon USA Inc IP Division

(57) ABSTRACT

A toner pattern is detected by a color misregistration detection sensor to detect a duration of contact between a development roller and a photosensitive drum. A contact/separation motor for driving the development roller is accelerated or decelerated based on the detected duration of contact between the development roller and the photosensitive drum. This control enables shortening the duration of contact between the development roller and the photosensitive drum, thus reducing the shortening of their lifetime.

15 Claims, 27 Drawing Sheets

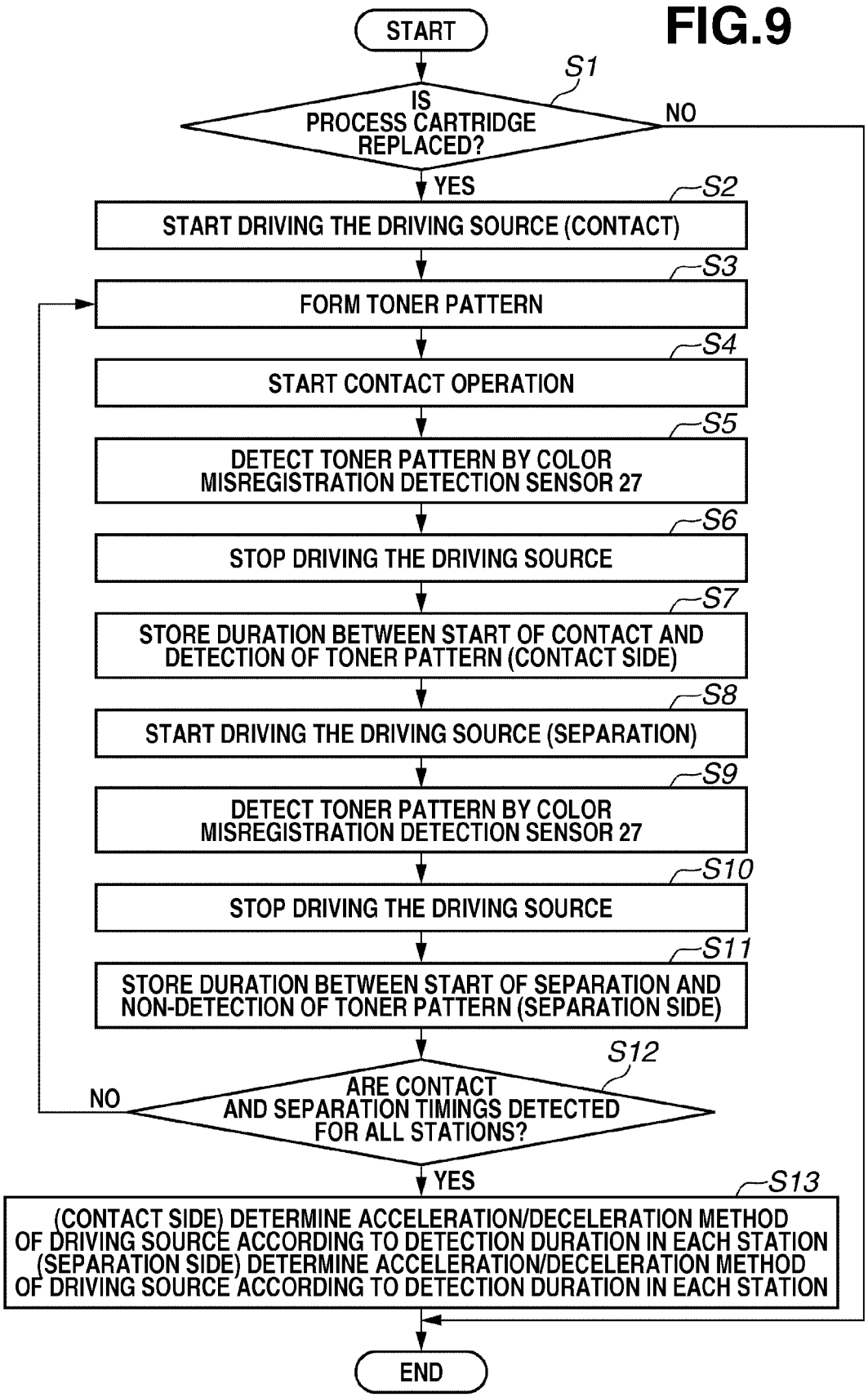
FIG.9
START
S1
IS PROCESS CARTRIDGE REPLACED?
NO
YES
S2
START DRIVING THE DRIVING SOURCE (CONTACT)
S3
FORM TONER PATTERN
S4
START CONTACT OPERATION
S5
DETECT TONER PATTERN BY COLOR MISREGISTRATION DETECTION SENSOR 27
S6
STOP DRIVING THE DRIVING SOURCE
S7
STORE DURATION BETWEEN START OF CONTACT AND DETECTION OF TONER PATTERN (CONTACT SIDE)
S8
START DRIVING THE DRIVING SOURCE (SEPARATION)
S9
DETECT TONER PATTERN BY COLOR MISREGISTRATION DETECTION SENSOR 27
S10
STOP DRIVING THE DRIVING SOURCE
S11
STORE DURATION BETWEEN START OF SEPARATION AND NON-DETECTION OF TONER PATTERN (SEPARATION SIDE)
S12
ARE CONTACT AND SEPARATION TIMINGS DETECTED FOR ALL STATIONS?
NO
YES
S13
(CONTACT SIDE) DETERMINE ACCELERATION/DECELERATION METHOD OF DRIVING SOURCE ACCORDING TO DETECTION DURATION IN EACH STATION (SEPARATION SIDE) DETERMINE ACCELERATION/DECELERATION METHOD OF DRIVING SOURCE ACCORDING TO DETECTION DURATION IN EACH STATION
END

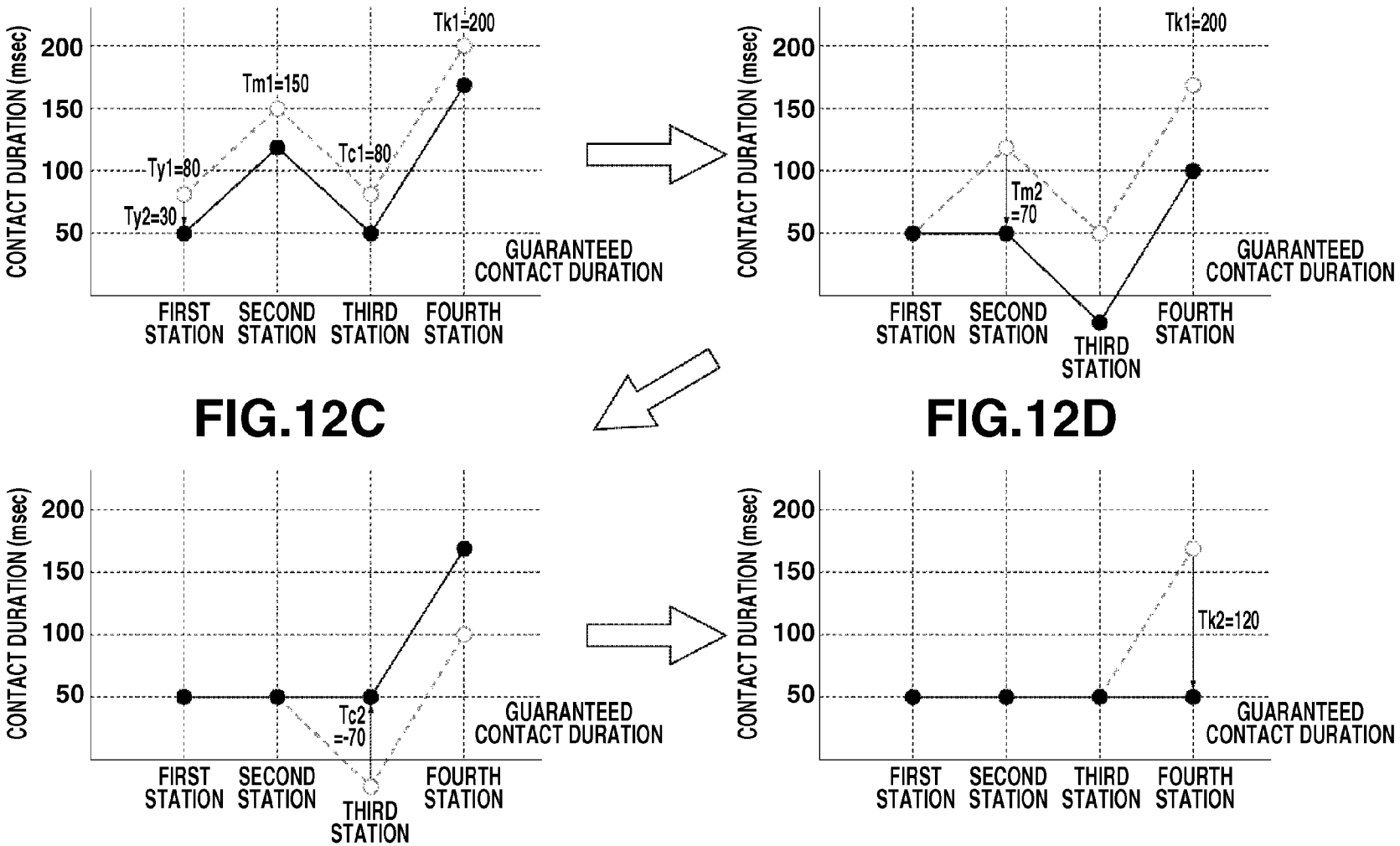
FIG.12A
CONTACT DURATION (msec)
200
150
100
50
Tk1=200
Tm1=150
Ty1=80
Tc1=80
Ty2=30
FIRST STATION
SECOND STATION
THIRD STATION
FOURTH STATION
GUARANTEED CONTACT DURATION
FIG.12B
CONTACT DURATION (msec)
200
150
100
50
Tk1=200
Tm2=70
FIRST STATION
SECOND STATION
THIRD STATION
FOURTH STATION
GUARANTEED CONTACT DURATION
FIG.12C
CONTACT DURATION (msec)
200
150
100
50
Tc2=-70
FIRST STATION
SECOND STATION
THIRD STATION
FOURTH STATION
GUARANTEED CONTACT DURATION
FIG.12D
CONTACT DURATION (msec)
200
150
100
50
Tk2=120
FIRST STATION
SECOND STATION
THIRD STATION
FOURTH STATION
GUARANTEED CONTACT DURATION

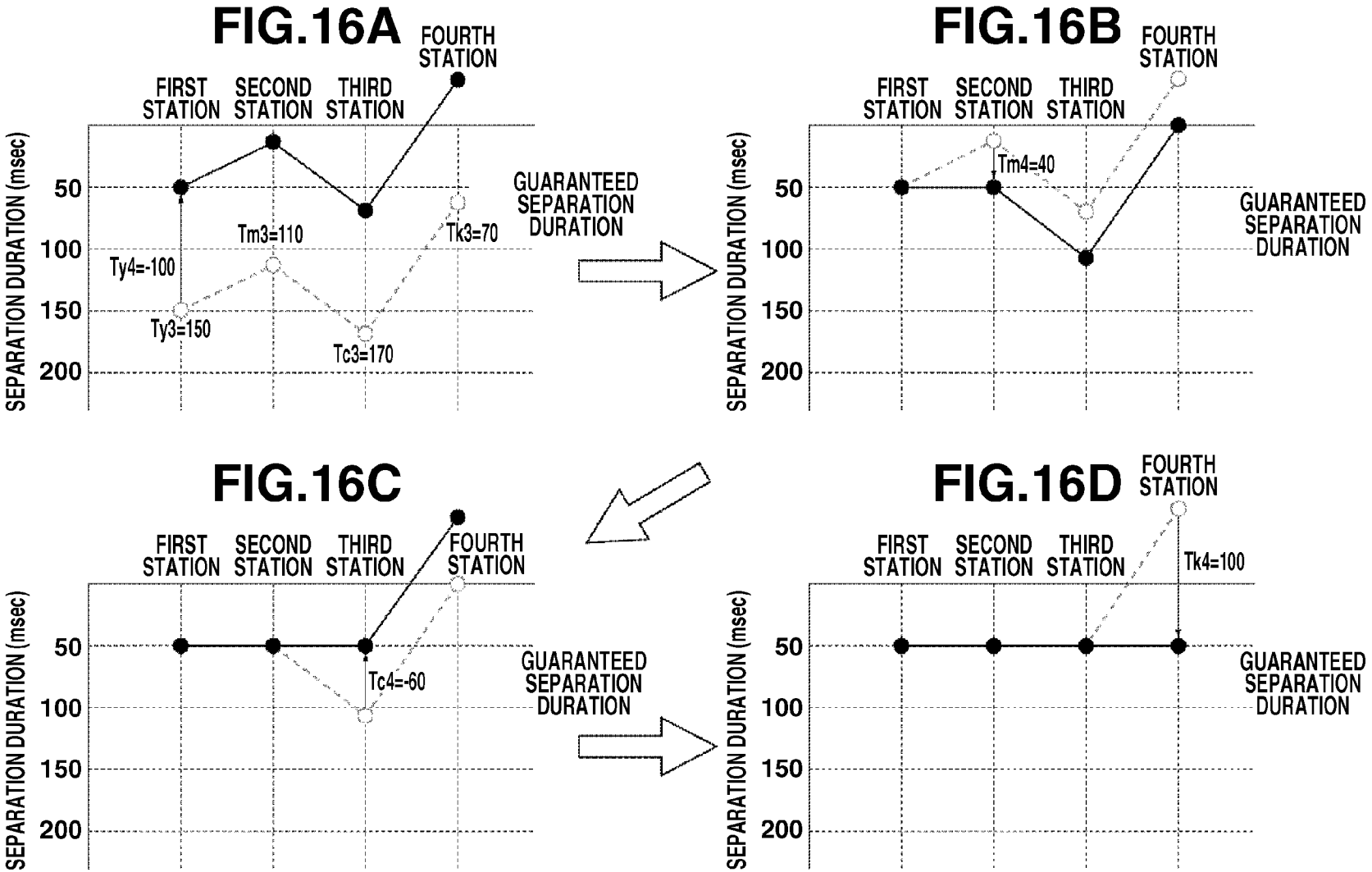
FIG.16A
FIRST STATION
SECOND STATION
THIRD STATION
FOURTH STATION
Tm3=110
Ty4=-100
Ty3=150
Tc3=170
Tk3=70
GUARANTEED SEPARATION DURATION
SEPARATION DURATION (msec)
50
100
150
200
FIG.16B
FIRST STATION
SECOND STATION
THIRD STATION
FOURTH STATION
Tm4=40
GUARANTEED SEPARATION DURATION
SEPARATION DURATION (msec)
50
100
150
200
FIG.16C
FIRST STATION
SECOND STATION
THIRD STATION
FOURTH STATION
Tc4=-60
GUARANTEED SEPARATION DURATION
SEPARATION DURATION (msec)
50
100
150
200
FIG.16D
FIRST STATION
SECOND STATION
THIRD STATION
FOURTH STATION
Tk4=100
GUARANTEED SEPARATION DURATION
SEPARATION DURATION (msec)
50
100
150
200

FIG.21

| STEP | EXCITATION DURATION (msec) | DRIVING FREQUENCY (pps) |
|---|---|---|
| 0 | 3.976 | 251.5 |
| 1 | 3.404 | 293.8 |
| 2 | 3.024 | 330.7 |
| 3 | 2.749 | 363.8 |
| 4 | 2.537 | 394.1 |
| 5 | 2.368 | 422.2 |
| 6 | 2.229 | 448.6 |
| 7 | 2.112 | 473.5 |
| 8 | 1.011 | 497.2 |
| 9 | 1.924 | 519.7 |
| 10 | 1.847 | 541.4 |
| 11 | 1.779 | 562.2 |
| 12 | 1.718 | 582.2 |
| 13 | 1.662 | 601.6 |
| 14 | 1.612 | 620.4 |
| 15 | 1.566 | 638.6 |
| 16 | 1.524 | 656.3 |
| 17 | 1.485 | 673.6 |
| 18 | 1.448 | 690.4 |
| 19 | 1.415 | 706.8 |
| 20 | 1.383 | 722.9 |
| 21 | 1.354 | 738.6 |
| 22 | 1.326 | 754.0 |
| 23 | 1.300 | 769.0 |
| 24 | 1.276 | 783.8 |
| 25 | 1.253 | 798.3 |
| 26 | 1.231 | 812.5 |
| 27 | 1.210 | 826.5 |
| 28 | 1.190 | 840.3 |
| 29 | 1.171 | 853.9 |
| 30 | 1.153 | 867.2 |

| STEP | EXCITATION DURATION (msec) | DRIVING FREQUENCY (pps) |
|---|---|---|
| 31 | 1.136 | 880.3 |
| 32 | 1.120 | 893.2 |
| 33 | 1.104 | 906.0 |
| 34 | 1.089 | 918.6 |
| 35 | 1.074 | 931.0 |
| 36 | 1.060 | 943.2 |
| 37 | 1.047 | 955.3 |
| 38 | 1.034 | 967.2 |
| 39 | 1.021 | 979.0 |
| 40 | 1.009 | 990.7 |
| 41 | 0.998 | 1002.2 |
| 42 | 0.987 | 1013.6 |
| 43 | 0.976 | 1024.8 |
| 44 | 0.965 | 1036.0 |
| 45 | 0.955 | 1047.0 |
| 46 | 0.945 | 1057.9 |
| 47 | 0.936 | 1068.7 |
| 48 | 0.926 | 1079.3 |
| 49 | 0.917 | 1089.9 |
| 50 | 0.909 | 1100.4 |
| 51 | 0.900 | 1110.8 |
| 52 | 0.892 | 1121.1 |
| 53 | 0.884 | 1131.2 |
| 54 | 0.876 | 1141.3 |
| 55 | 0.869 | 1151.3 |
| 56 | 0.861 | 1161.3 |
| 57 | 0.854 | 1171.1 |
| 58 | 0.847 | 1180.8 |
| 59 | 0.840 | 1190.5 |
| 60 | 0.833 | 1200.0 |

IMAGE FORMING APPARATUS

BACKGROUND OF THE INVENTION

1. Field of the Invention

The present invention relates to an image forming apparatus having image bearing members and development units for developing latent images formed on the image bearing members.

2. Description of the Related Art

With some of conventional image forming apparatuses based on the electrophotographic process, an image formed on each of a plurality of image-forming photosensitive drums is transferred onto an intermediate transfer belt facing them, or onto a conveyed transfer material, in succession and layered on top of one another. This process is referred to as an in-line method. A contact development method can be employed by such image forming apparatuses. This contact development method performs development with development rollers, as developer bearing members, in rotational contact with the photosensitive drums.

When development is performed by using the contact development method, since the development rollers and photosensitive drums are rotationally driven while they are in contact with each other, the photosensitive drums and development rollers are worn out by friction therebetween. Therefore, leaving contact between a photosensitive drum and a development roller for a longer duration than necessary shortens their lifetime. To address this situation, a configuration for enabling contact and separation between the development roller and the photosensitive drum is discussed in Japanese Patent Application Laid-Open No. 2006-292868.

However, contact and separation between the photosensitive drum and the development roller in the development process involve member attachment error, driving source (motor) control timing, and other variation factors. In consideration of such variation factors, therefore, conventional techniques provide a predetermined amount of margin before and after the contact duration for performing image formation, thus causing the development rollers to securely contact the photosensitive drums during the image forming duration.

Since this margin causes a contact state between the development roller and the photosensitive drum even while image formation is not performed, the lifetime of the development rollers and photosensitive drums may be shortened.

SUMMARY OF THE INVENTION

The present invention is directed to an image forming apparatus capable of reducing the shortening of the lifetime of photosensitive drums and development rollers due to unnecessary contact therebetween.

According to an aspect of the present invention, an image forming apparatus includes a first image bearing member, a second image bearing member, a first development unit configured to contact the first image bearing member having a latent image formed thereon to develop the latent image, a second development unit configured to contact the second image bearing member having a latent image formed thereon to develop the latent image, wherein the image forming apparatus is capable of changing over between a state where the first image bearing member is separated from the first development unit and a state where the first image bearing member is in contact with the first development unit to enable developing the latent image, and is capable of changing over between a state where the second image bearing member is separated from the second development unit and a state where the second image bearing member is in contact with the second development unit to enable developing the latent image, a detection unit configured to detect a first contact duration during which the first image bearing member is in contact with the first development unit and a second contact duration during which the second image bearing member is in contact with the second development unit, and a control unit configured to control contact or separation timing between the first image bearing member and the first development unit according to the first contact duration detected by the detection unit, wherein, after performing timing control for the first image bearing member and the first development unit, the control unit controls contact or separation timing between the second image bearing member and the second development unit according to the first and second contact durations detected by the detection unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 9 is a flow chart of a control program for detecting contact and separation timings.

FIGS. 12A to 12D illustrate a method for correcting the contact duration at each station.

FIGS. 16A to 16D illustrate a method for correcting the separation duration at each station.

FIG. 21 illustrates a driving frequency table for the contact/separation motor.

DESCRIPTION OF THE EMBODIMENTS

Various exemplary embodiments, features, and aspects of the invention will be described in detail below with reference to the drawings.

Figure 1:
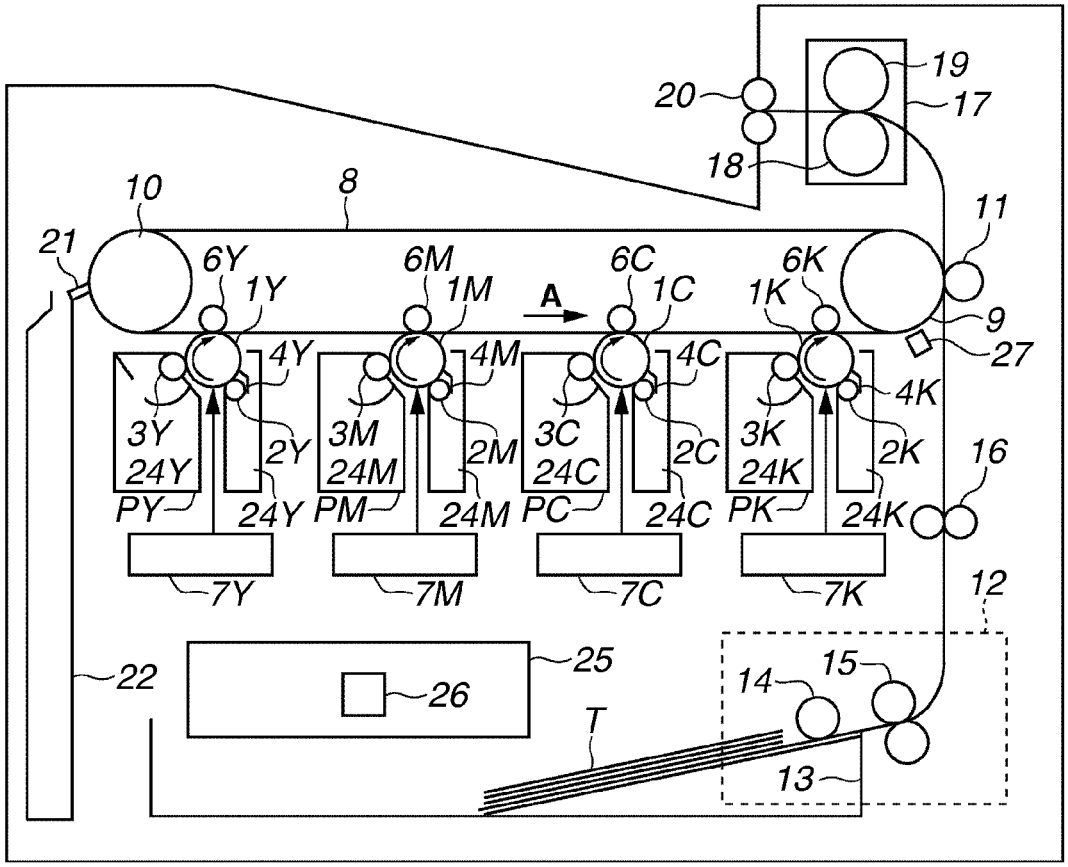
FIG. 1 is a schematic view of an image forming apparatus according to an exemplary embodiment of the present invention.

FIG. 1 illustrates a color image forming apparatus using an intermediate transfer belt, which is an intermediate transfer member, according to a first exemplary embodiment of the present invention. A plurality of process cartridges P (PY, PM, PC, and PK) are removably mounted to the image forming apparatus. These process cartridges PY, PM, PC, and PK, having a similar structure, respectively include toner containers 23Y, 23M, 23C, and 23K; photosensitive drums 1Y, 1M, 1C, and 1K, which are image bearing members; charging rollers 2Y, 2M, 2C, and 2K; development rollers 3Y, 3M, 3C, and 3K; drum cleaning blades 4Y, 4M, 4C, and 4K; and waste toner containers 24Y, 24M, 24C, and 24K. The toner containers 23Y, 23M, 23C, and 23K contain yellow (Y), magenta (M), cyan (C), and black (K) toner, respectively.

The photosensitive drums 1Y, 1M, 1C, and 1K are charged to a predetermined negative potential by the charging rollers 2Y, 2M, 2C, and 2K, respectively. Then, electrostatic latent images are formed on the photosensitive drums 1Y, 1M, 1C, and 1K by laser units 7Y, 7M, 7C, and 7K, respectively. The electrostatic latent images on the photosensitive drums are developed, and negatively charged toner is applied thereto by the development rollers 3Y, 3M, 3C, and 3K, respectively. Then, toner images Y, M, C, and K are formed on the photosensitive drums 1Y, 1M, 1C, and 1K, respectively.

The intermediate transfer belt unit includes an intermediate transfer belt 8, a drive roller 9, and a driven roller 10. Primary transfer rollers 6Y, 6M, 6C, and 6K are disposed inside the intermediate transfer belt 8, respectively facing the photosensitive drums 1Y, 1M, 1C, and 1K, to apply transfer bias thereto by a bias application unit (not illustrated). A color misregistration detection sensor 27 (optical sensor) is disposed in the vicinity of the drive roller 9 to detect a toner pattern for color misregistration detection formed on the intermediate transfer belt 8.

The color misregistration detection sensor 27 includes an infrared light emitting element such as a light-emitting diode (LED), a light-sensitive element such as a photo-diode, an IC for processing light-sensitive data, and a holder for storing these components. The principle of toner pattern detection is that infrared light emitted by the light-emitting element is reflected by the toner pattern, and the intensity of the reflected light is detected by the light-sensitive element to detect presence or absence of the toner pattern of each color. Either regular or diffuse reflected light may be detected as the reflected light.

While the photosensitive drums 1Y, 1M, 1C, and 1K are rotating in the direction of respective arrows, and the intermediate transfer belt 8 is moving in the direction of arrow A, positive bias is applied to the primary transfer rollers 6Y, 6M, 6C, and 6K to transfer toner images formed on the photosensitive drums 1Y, 1M, 1C, and 1K onto the intermediate transfer belt 8 in this order, thus forming a four-color (Y, M, C, and K) toner image thereon. The four-color toner image is conveyed to a secondary transfer roller 11.

A sheet conveyance unit 12 includes a feed roller 14 which feeds a transfer material T from a feed cassette 13 containing transfer materials T, and a conveyance roller pair 15 which conveys the fed transfer material T. The transfer material T conveyed by the sheet conveyance unit 12 is further conveyed to the secondary transfer roller 11 by a registration roller pair 16. By applying positive bias to the secondary transfer roller 11, the image formed on the intermediate transfer belt 8 is secondarily transferred onto the conveyed transfer material T. The transfer material T having the secondarily transferred image thereon is further conveyed to a fixing unit 17, in which it is heated and pressurized by a fixing film 18 and a pressurization roller 19 for fixing. The fixed transfer material T is discharged by a discharge roller pair 20.

Meanwhile, toner remaining on the surfaces of the photosensitive drums 1Y, 1M, 1C, and 1K after primary transfer is removed by cleaning blades 4Y, 4M, 4C, and 4K, respectively. Toner remaining on the intermediate transfer belt 8 after secondary transfer to the transfer material T is removed by the transfer belt cleaning blade 21, and the removed toner is collected into a waste toner container 22.

A control substrate 25 in FIG. 1 mounts an electric circuit for controlling the image forming apparatus as well as a central processing unit (CPU) 26. The CPU 26 totally controls operations of the image forming apparatus, including control of a driving source such as a motor (not illustrated) related to conveyance of the transfer material T, control of a driving source such as a motor (not illustrated) related to the process cartridges PY, PM, PC, and PK, control related to image formation, and control related to failure detection. The control substrate 25 is provided with a motor drive IC, which controls the drive of a contact/separation motor 31. The CPU 26 transmits a pulse signal (based on the two-phase excitation method in the present exemplary embodiment) to the motor drive IC to select excitation of the contact/separation motor 31. Upon reception of the pulse signal, the motor drive IC controls the direction of a current flowing in a coil of the contact/separation motor 31 in response to the pulse signal. In this case, a field pole in the contact/separation motor 31 is inverted and a rotor magnet rotates. The rotational speed of the contact/separation motor 31 depends on the frequency (hereinafter referred to as driving frequency) of the pulse signal sent from the CPU 26. Specifically, the higher the driving frequency, the shorter the inversion interval of the field pole in the contact/separation motor 31 and accordingly the higher the rotational speed of the contact/separation motor 31.

Figure 2:
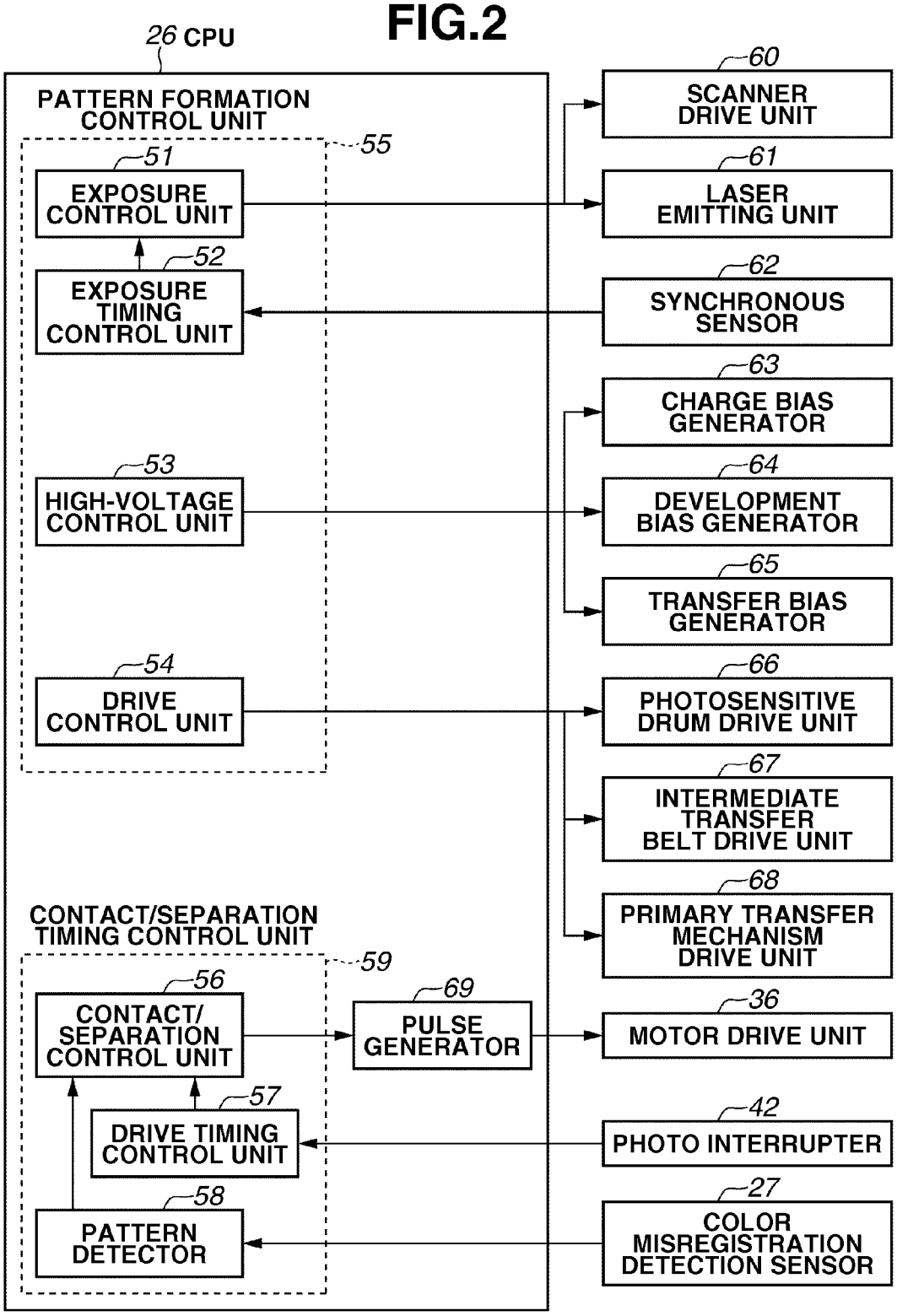
FIG. 2 illustrates a configuration of the image forming apparatus.

FIG. 2 is a block diagram illustrating a configuration of the image forming apparatus. The CPU 26 includes a pattern formation control unit 55, which forms toner patterns, and a contact/separation timing control unit 59, which controls contact and separation between the development roller 3 and the photosensitive drum 1 based on the detected toner pattern.

Figure 8A:
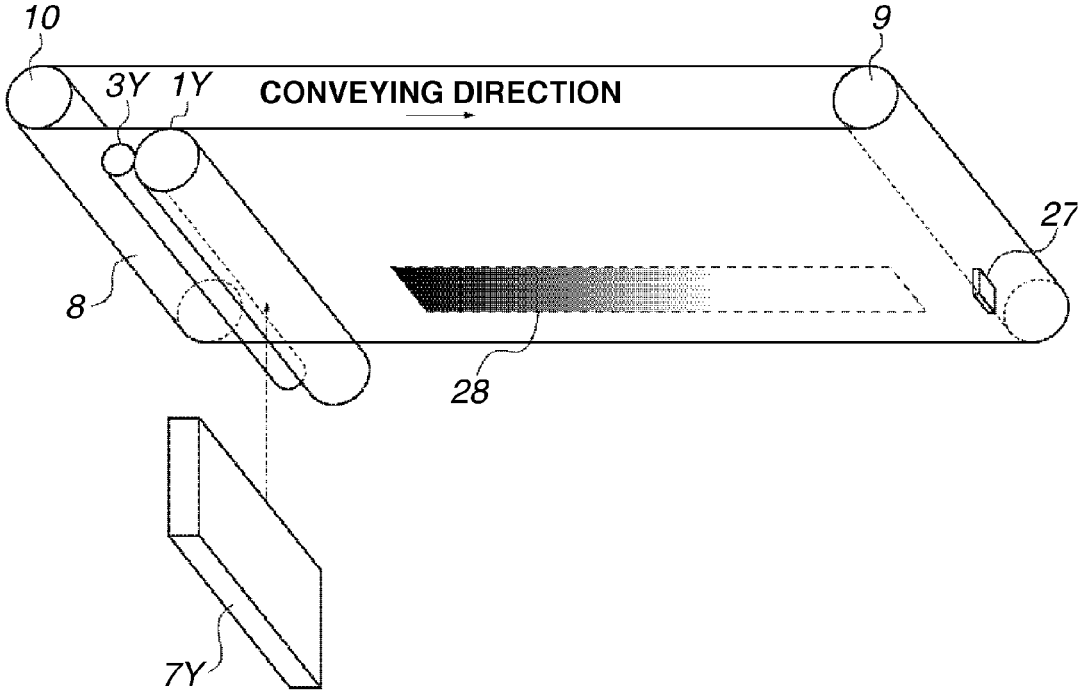
FIGS. 8A and 8B illustrate a toner pattern and a color misregistration detection sensor.
Figure 8B:
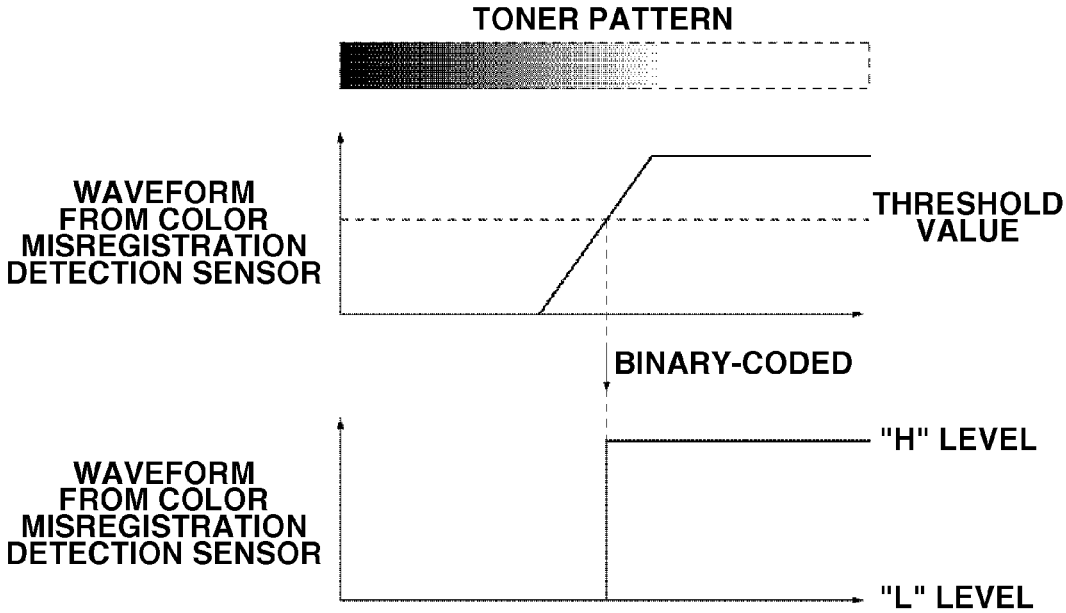

The pattern formation control unit 55 includes an exposure control unit 51, an exposure timing control unit 52, a high-voltage control unit 53, and a drive control unit 54. The exposure control unit 51 controls a scanner drive unit 60, which rotatably drives a polygon mirror (not illustrated) in a laser unit 7, and a laser emitting unit 61, which emits laser light. The laser unit 7 includes a synchronous sensor 62, which detects laser light reflected by the polygon mirror. The synchronous sensor 62 sends a detection signal to the exposure timing control unit 52 in the pattern formation control unit 55. The exposure timing control unit 52 generates a timing with reference to the detection signal input from the synchronous sensor 62. The exposure control unit 51 drives the laser emitting unit 61 based on the generated timing. Electrostatic latent images are formed on the photosensitive drums 1 by the laser light from the laser emitting unit 61. The formed electrostatic latent images are developed by the development rollers 3 to form respective toner patterns. Controlling laser emission timing with reference to the synchronous sensor 62 enables forming a toner pattern within a range detected by the color misregistration detection sensor 27 as illustrated in FIGS. 8A and 8B.

The high-voltage control unit 53 controls a charging bias generator 63, a development bias generator 64, and a transfer bias generator 65, which generate necessary voltages for image formation. The drive control unit 54 controls a photosensitive drum drive unit 66, an intermediate transfer belt drive unit 67, and a primary transfer mechanism drive unit 68 as drive control for image formation.

The contact/separation timing control unit 59 includes a contact/separation control unit 56, a drive timing control unit 57, and a pattern detector 58. The contact/separation control unit 56 controls a pulse generator 69 for driving the contact/separation motor 31. The pulse generator 69 generates a pulse signal and sends it to a motor drive unit (motor drive IC) 36. The drive timing control unit 57 receives a signal from a photo interrupter 42 (position detection sensor) and uses it for contact/separation control. The pattern detector 58 receives the result of toner pattern detection from the color misregistration detection sensor 27 and then reflects the result to contact/separation control for image formation.

A mechanism for providing contact and separation between the development roller 3 and the photosensitive drum 1 will be described below with reference to FIGS. 3A to 3C. A stepping motor is used as the contact/separation motor 31, which is a driving source for providing contact and separation between the development roller 3 and the photosensitive drum 1. The contact/separation motor 31 is connected with a drive change shaft 32 via a pinion gear. In the present exemplary embodiment, although a stepping motor is used as the contact/separation motor 31, the driving source for contact/separation operation is not limited thereto but may be a DC brush motor, a DC brushless motor, etc. The drive change shaft 32 is provided with worm gears 33 (33Y, 33M, 33C, and 33K) thereon. The drive change shaft 32 rotates to drive cam gears 34 (34Y, 34M, 34C, and 34K) for respective colors via the worm gears 33. Then, as phases of cams 35 of the cam gears 34 change, the cams 35 press and release pressing to the side faces of the process cartridges P, thus providing contact and separation between the photosensitive drum 1 and the development roller 3.

Figure 3A:
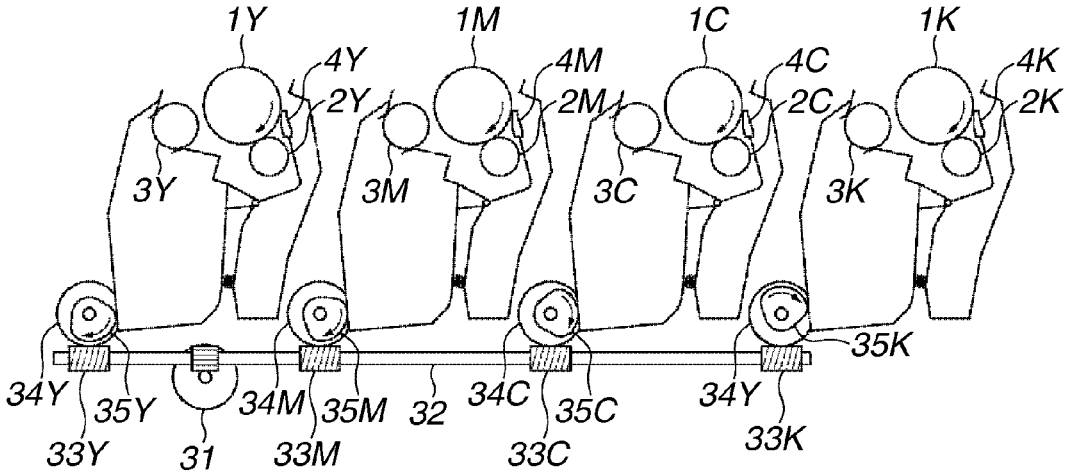
FIGS. 3A to 3C illustrate a mechanism for providing contact and separation between the development roller and the photosensitive drum.
Figure 3B:
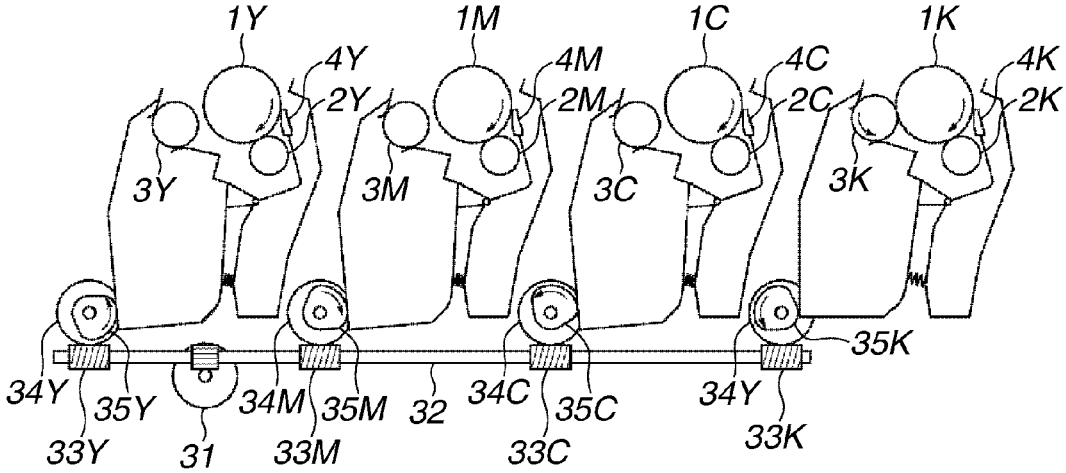
Figure 3C:
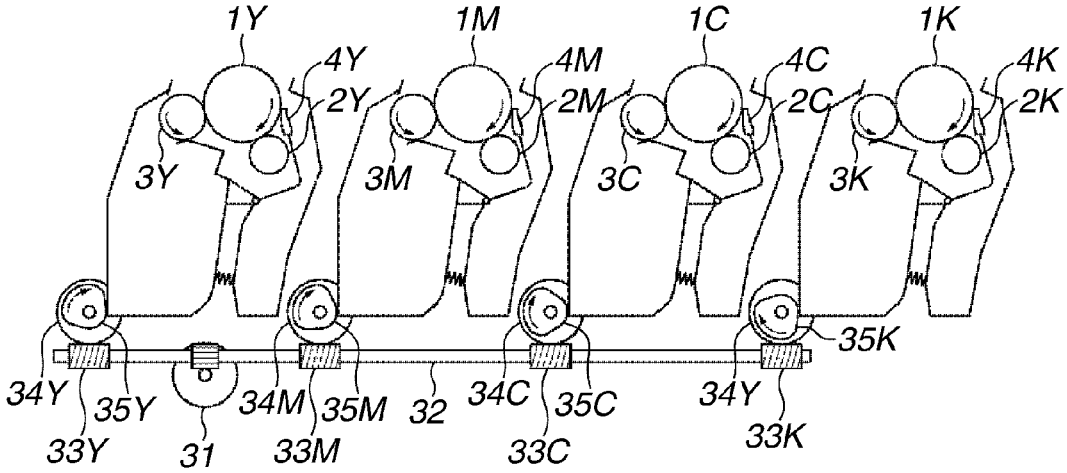

FIG. 3A illustrates a standby state (complete separation) in which the cams 35 (35Y, 35M, 35C, and 35K) press with their maximum radius the side faces of the process cartridges P (PY, PM, PC, and PK), respectively, to allow the development rollers 3 (3Y, 3M, 3C, and 3K) to separate from their respective photosensitive drums 1 (1Y, 1M, 1C, and 1K). FIG. 3B illustrates a full-color contact state in which the cams 35 (35Y, 35M, 35C, and 35K) release pressing to the side faces of the process cartridges P (PY, PM, PC, and PK), respectively, to allow the development rollers 3 (3Y, 3M, 3C, and 3K) to contact their respective photosensitive drums 1 (1Y, 1M, 1C, and 1K). FIG. 3C illustrates a state in which the cams 35 (35Y, 35M, and 35C) for yellow (Y), magenta (M), and cyan (C) press with their maximum radius the side faces of the process cartridges P (PY, PM, and PC) for yellow (Y), magenta (M), and cyan (C), respectively. In this state, only the cam 35K for black (K) releases pressing to the side face of the process cartridge PK to allow the development roller 3K for black (K) to contact the photosensitive drum 1K. This state is referred to as a monochrome contact state.

A state transition from the standby state in FIG. 3A to the full-color contact state in FIG. 3B and a state transition from the standby state in FIG. 3A to the monochrome contact state in FIG. 3C will be described below. When the contact/separation motor 31 is forwardly rotated in the standby state in FIG. 3A, each of the cams 35Y, 35M, 35C, and 35K rotates clockwise. The phases of the cams 35M, 35C, and 35K are shifted in this order more counterclockwise than the phase of the cam 35Y.

Due to this phase shift, when the cams 35Y, 35M, 35C, and 35K rotate clockwise, the cam 35Y releases pressing to the side face of the process cartridge PY first. Subsequently, the cams 35M, 35C, and 35K release pressing to the side faces of the process cartridges PM, PC, and PK, respectively, in this order according to the degree of phase shift. Thus, when the contact/separation motor 31 is forwardly rotated from the standby state in FIG. 3A, the development rollers 3 (3Y, 3M, 3C, and 3K) contact the photosensitive drums 1 (1Y, 1M, 1C, and 1K), respectively, in this order, thus resulting in the full-color contact state in FIG. 3B. When the contact/separation motor 31 is further forwardly rotated, the development rollers 3 (3Y, 3M, 3C, and 3K) separate from the photosensitive drums 1 (1Y, 1M, 1C, and 1K), respectively, in this order, thus resulting in a state transition from the full-color contact state to the standby state.

In the standby state in FIG. 3A, when the contact/separation motor 31 is reversely rotated, each of the cams 35Y, 35M, 35C, and 35K rotates counterclockwise. When the contact/separation motor 31 is reversely rotated, the cam 35K releases pressing to the side face of the process cartridge PK first. When the contact/separation motor 31 is stopped in this state, the result is the monochrome contact state in FIG. 3C. When the contact/separation motor 31 is further forwardly rotated, the cam 35K presses the side face of the process cartridge PK again, thus resulting in a state transition from the monochrome contact state to the standby state. In this way, the image forming apparatus is able to control contact and separation between the development roller 3 and the photosensitive drum 1 by controlling the rotational direction and the rotation amount of the contact/separation motor 31 as the three states in FIGS. 3A to 3C.

Figure 4A:
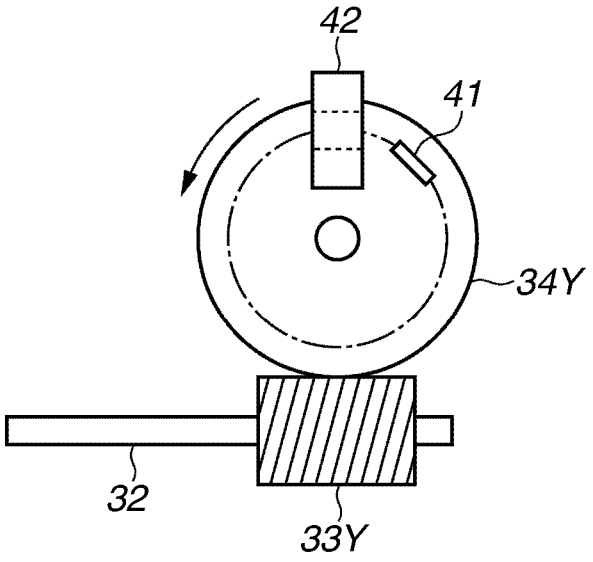
FIGS. 4A and 4B illustrate a configuration of a cam gear.
Figure 4B:
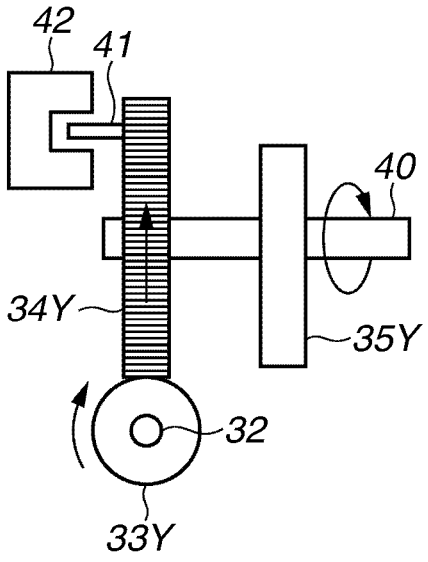

This control can be attained by a rib 41 partially provided on a cam gear 34 for yellow (Y) as illustrated in FIGS. 4A and 4B. As the cam gear 34Y rotates, the rib 41 also rotates interrupting light of the photo interrupter 42. The phase of the cam 35Y rotating with the cam gear 34 can be detected based on a signal output from the photo interrupter 42. The number of driving steps of the contact/separation motor 31 is managed with respect to a reference position at which light of the photo interrupter 42 is interrupted, thus controlling the phase (standby state, full-color contact state, and monochrome contact state) of the cam 35Y. The cam gear 34 and the cam 35Y are concentrically mounted on a shaft 40.

Figure 5:
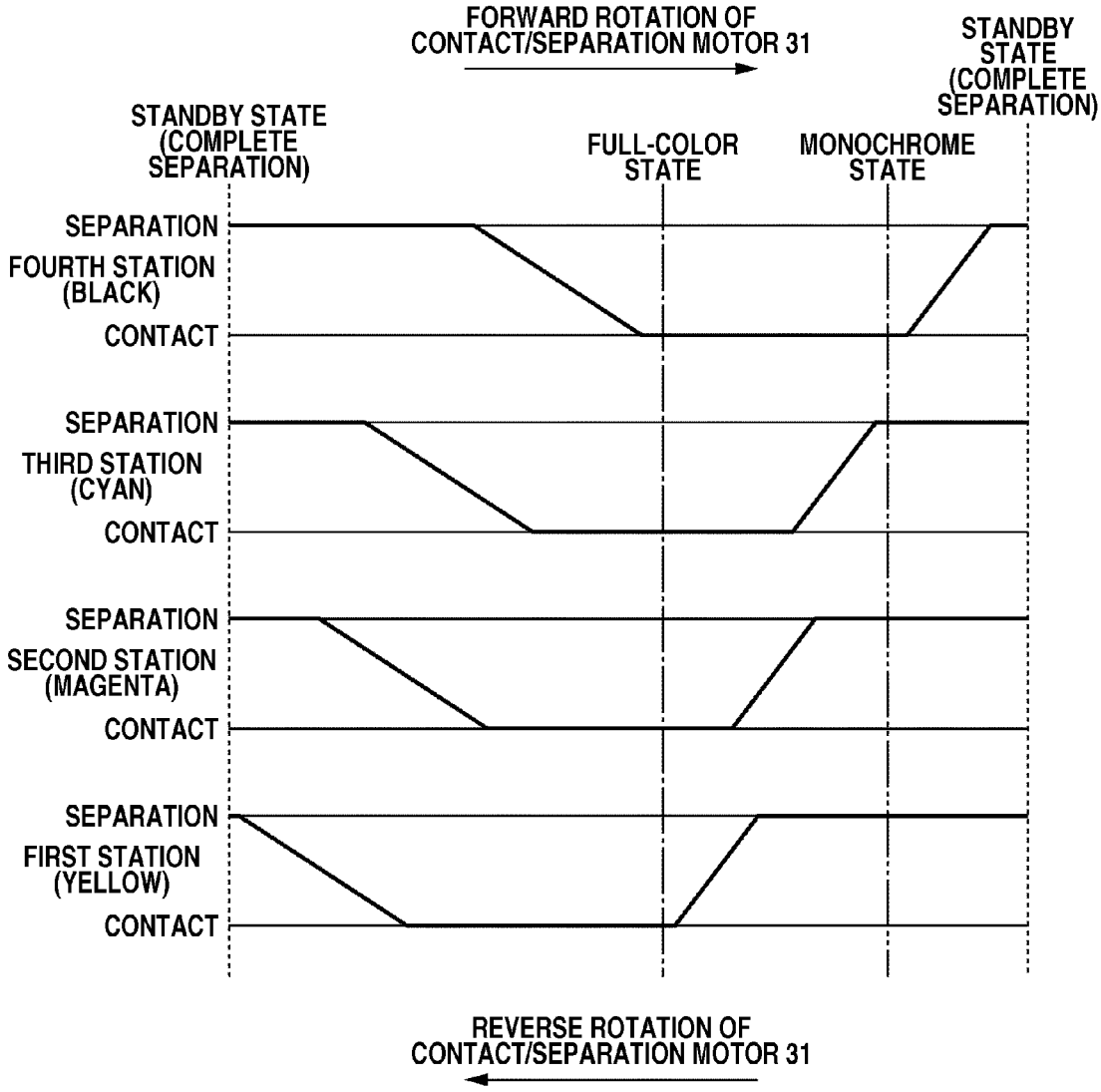
FIG. 5 is a cam diagram illustrating contact and separation states between the development roller and the photosensitive drum.

FIG. 5 is a cam diagram illustrating phase transitions of the cam gears 34 and a relation between the three controllable states. As illustrated in the cam diagram of FIG. 5, contact/separation state changeover control is attained by shifting driving phases of the cams 35Y, 35M, 35C, and 35K. The cam diagram illustrated in FIG. 5 denotes design center values. It is naturally subject to variation factors such as dimensional variations of the components illustrated in FIGS. 3A to 3C.

In an ordinary printing operation, contact and separation between the development roller 3 and the photosensitive drum 1 are changed, specifically, from the standby state to the full-color contact state or from the standby state to the monochrome contact state according to a timing to start image formation.

Firstly, contact/separation state changeover control for full-color printing will be described below. A combination of the development roller 3 and photosensitive drum 1 forms each image forming station. Specifically, an image forming station that performs image formation with yellow toner is referred to as a first image forming station (also simply referred to as first station or 1st). Likewise, image forming stations that perform image formation with magenta, cyan, and black toners are referred to as second, third, and fourth image forming stations (also simply referred to as second, third, and fourth stations, or 2st, 3st, and 4st), respectively.

When performing full-color printing, the contact/separation motor 31 is forwardly rotated by a predetermined number of steps according to a timing to start image formation. When the contact/separation motor 31 starts being forwardly rotated, each station undergoes an indefinite duration during which the respective development roller 3 and photosensitive drum 1 may or may not be in contact with each other. Then, contact between the development roller 3 and the photosensitive drum 1 is established in order of the first station (yellow), second station (magenta), third station (cyan), and fourth station (black), as illustrated in FIGS. 3A to 3C. Upon completion of contact at a station, image formation is started at the station. The number of driving steps of the contact/separation motor 31 is such that the contact/separation motor 31 stops when all of the stations complete contact. After completion of image formation, the contact/separation motor 31 is forwardly rotated again by a predetermined number of steps. When the contact/separation motor 31 starts being forwardly rotated, each station undergoes an indefinite duration. Then, separation between the development roller 3 and the photosensitive drum 1 is established in order of the first station (yellow), second station (magenta), third station (cyan), and fourth station (black). The number of driving steps of the contact/separation motor 31 is such that the contact/separation motor 31 stops when all of the stations complete separation.

Secondly, contact/separation state changeover control for monochrome printing will be described below. When performing monochrome printing, the contact/separation motor 31 is reversely rotated by a predetermined number of steps according to a timing to start image formation. When the contact/separation motor 31 starts being reversely rotated, the fourth image forming apparatus (black) undergoes an indefinite duration. Then, contact between the development roller 3K and the photosensitive drum 1K of the fourth station (black) is established, and the fourth station (black) starts image formation. The number of driving steps of the contact/separation motor 31 is such that the contact/separation motor 31 stops when only the fourth station (black) completes contact. Upon completion of image formation, the contact/separation motor 31 is forwardly rotated by a predetermined number of driving steps. When the contact/separation motor 31 starts being forwardly rotated, separation between the development roller 3K and the photosensitive drum 1K of the fourth station (black) is established, and the fourth image forming apparatus (black) completes printing. The number of driving steps of the contact/separation motor 31 is such that the contact/separation motor 31 stops when all of the stations complete separation.

Figure 6:
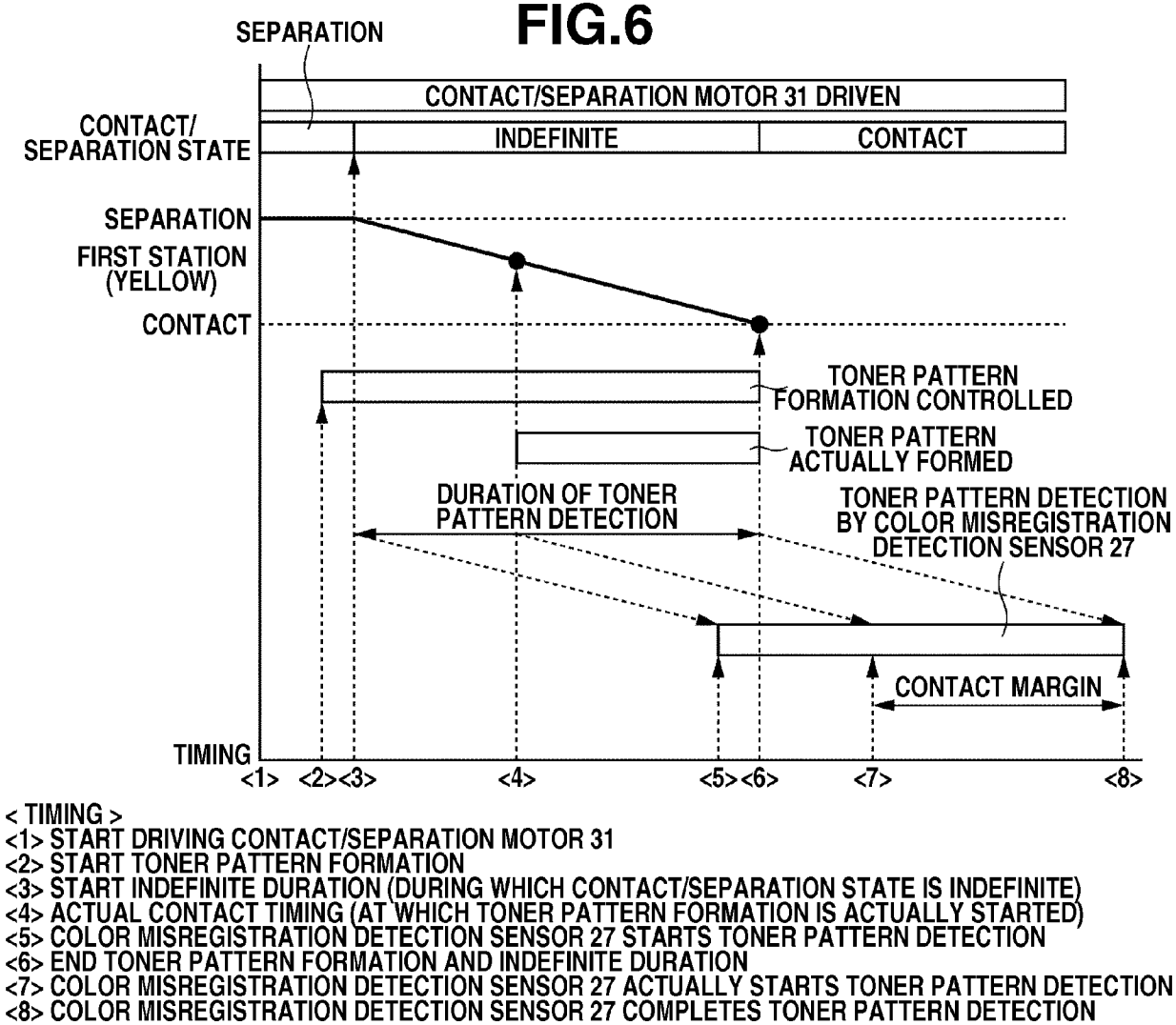
FIG. 6 is a timing chart for detecting contact timing.

A method for detecting a contact margin will be described below with reference to the timing chart of FIG. 6. For example, a method for detecting a contact margin at the first station (Y) will be described below. Since a similar method can also be applied to other stations, descriptions for other stations will be omitted. The contact margin refers to a time duration between the timing to start contact and the timing to start toner pattern formation after contact between the development roller 3Y and the photosensitive drum 1Y is established during the indefinite duration. Referring to FIG. 6, the indefinite duration refers to a time duration that includes a threshold between contact and separation states, as mentioned above.

At timing <1>, the contact/separation motor 31 is started to change the first station (Y) from the separation state to the contact state. At timing <2>, before the first station (Y) enters the indefinite duration in the contact/separation changeover process, formation of an electrostatic latent image of yellow toner pattern (Y) on the surface of the photosensitive drum 1Y is started by exposure from the laser unit 7Y. Formation of the electrostatic latent image is continued until the contact state is achieved. At timing <3>, the first station (Y) enters the indefinite duration during which the state between the development roller 3Y and the photosensitive drum 1Y is indefinite. At timing <4>, the development roller 3Y contacts the photosensitive drum 1Y by driving the contact/separation motor 31, and a toner pattern 28 is formed on the photosensitive drum 1Y. The formed toner pattern 28 is transferred onto the intermediate transfer belt 8.

At timing <5>, the color misregistration detection sensor 27 starts detecting the toner pattern on the intermediate transfer belt 8. At timing <6>, contact between the development roller 3Y and the photosensitive drum 1Y is completed, and toner pattern formation is completed. At timing <7>, the color misregistration detection sensor 27 detects the toner pattern 28 on the intermediate transfer belt 8. At timing <8>, it ends toner pattern detection.

The contact margin refers to a time duration between timing <7> at which the color misregistration detection sensor 27 starts detecting the toner pattern 28 transferred onto the intermediate transfer belt 8 and timing <8> at which it ends toner pattern detection.

Figure 7:
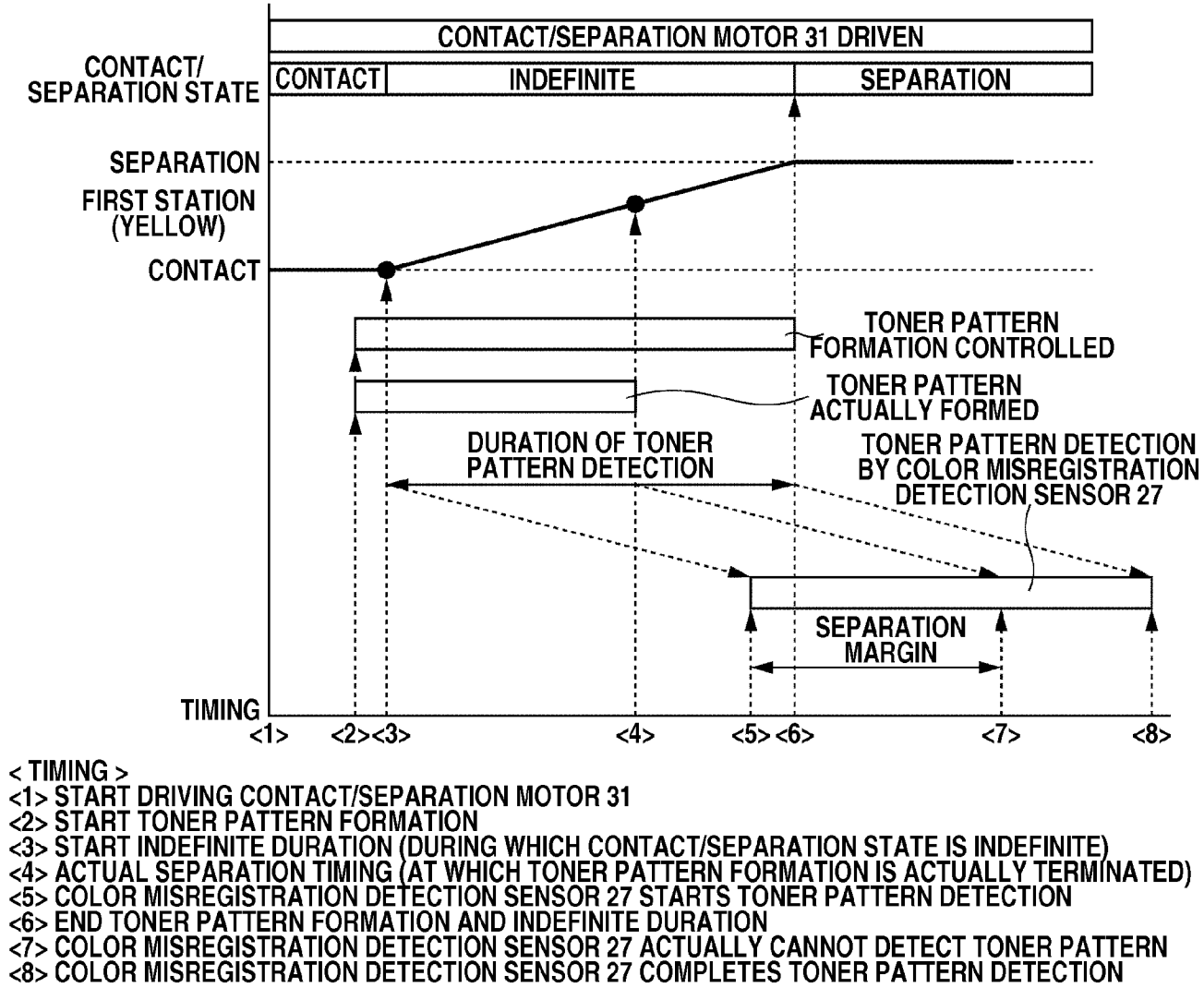
FIG. 7 is a timing chart for detecting separation timing.

A method for detecting a separation margin will be described below with reference to the timing chart of FIG. 7. Similar to the contact margin, a method for detecting a separation margin at the first station (Y) will be described below. Since a similar method can also be applied to other stations, descriptions for other stations will be omitted. The separation margin refers to a time duration between the timing to start separation and the timing to end toner pattern formation after separation between the development roller 3Y and the photosensitive drum 1Y is established during the indefinite duration.

At timing <1>, the contact/separation motor 31 is started to change the first station (Y) from the contact state to the separation state. At timing <2>, the first station (Y) starts toner pattern formation. At timing <3>, the first station (Y) enters the indefinite duration during which the state between the development roller 3Y and the photosensitive drum 1Y is indefinite. At timing <4>, the development rollers 3 and the photosensitive drums 1 are separated, and toner pattern development onto the photosensitive drum 1Y is ended. The toner pattern formed on the photosensitive drum 1Y is transferred onto the intermediate transfer belt 8.

At timing <5>, the color misregistration detection sensor 27 starts detecting the toner pattern on the intermediate transfer belt 8. At timing <6>, separation between the development roller 3Y and the photosensitive drum 1Y is completed, and formation of electrostatic latent image onto the photosensitive drum 1Y is ended. At timing <7>, the color misregistration detection sensor 27 can no longer detect the toner pattern formed on the intermediate transfer belt 8. At timing <8>, it ends toner pattern detection.

The contact margin refers to a time duration between timing <5> at which the color misregistration detection sensor 27 starts detecting the toner pattern transferred onto the intermediate transfer belt 8 and timing <7> at which it can no longer detect the toner pattern.

FIG. 8A illustrates yellow (Y) toner pattern formation on the intermediate transfer belt 8. The toner pattern in FIG. 8A is wider than the (optical) detection area of the color misregistration detection sensor 27. When the toner pattern on the intermediate transfer belt 8 passes through the detection position of the color misregistration detection sensor 27, a signal from the color misregistration detection sensor 27 changing as illustrated in FIG. 8B is binary-coded by an IC therein and then sent to the CPU 26. This allows the toner pattern formed on the intermediate transfer belt 8 to be detected. Although description has specifically been made of the toner pattern formed on the intermediate transfer belt 8, the target of transfer is not limited thereto but the toner pattern may be formed on, for example, a recording-medium conveyance belt.

A method for detecting contact and separation timings, and a method for controlling these timings according to detected contact/separation timings will be described below. FIG. 9 is a flow chart of a control program for detecting contact and separation timings.

In step S1, the program checks whether or not a process cartridge is replaced. When the process cartridge is not replaced (NO in step S1), the program terminates processing. When the process cartridge is replaced (YES in step S1), the program proceeds to step S2 to start driving the driving source (the contact/separation motor 31) to detect contact timing. In step S3, the program forms a toner pattern used to detect the contact/separation state.

In step S4, the program starts establishing contact between the development roller 3 and the photosensitive drum 1. In step S5, the color misregistration detection sensor 27 detects the toner pattern formed on the intermediate transfer belt 8. In step S6, the program stops the driving source with a contact state between the development roller 3 and the photosensitive drum 1. In step S7, the program calculates a contact margin, that is, a duration between the time when contact between the development roller 3 and the photosensitive drum 1 is started and the time when the color misregistration detection sensor 27 detects the toner pattern, and stores it in memory.

In step S8, the program starts driving the driving source (the contact/separation motor 31) from the contact state between the development roller 3 and the photosensitive drum 1 to detect separation timing. In step S9, the color misregistration detection sensor 27 detects a timing at which a toner pattern is no longer formed on the intermediate transfer belt 8 by the separation between the development roller 3 and the photosensitive drum 1. In step S10, the program stops driving the driving source with a separation state between the development roller 3 and the photosensitive drum 1. In step S11, the program calculates a separation margin, that is, a duration between the time when separation between the development roller 3 and the photosensitive drum 1 is started and the time when the color misregistration detection sensor 27 can no longer detect the toner pattern, and stores it in memory.

In step S12, the program determines whether contact/separation timing detection is completed at all of the stations. When contact/separation timing detection is not completed at any station (NO in step S12), the program returns to step S3 to repeat contact/separation duration detection. When contact/separation timing detection is completed at all of the stations (YES in step S12), the program proceeds to step S13 to control the driving speed of the contact/separation motor 31 based on the detected contact/separation margin stored in memory to optimize the contact duration at each station. A method for determining the driving speed of the contact/separation motor 31 from the detection result will be described below in detail.

Figure 10:
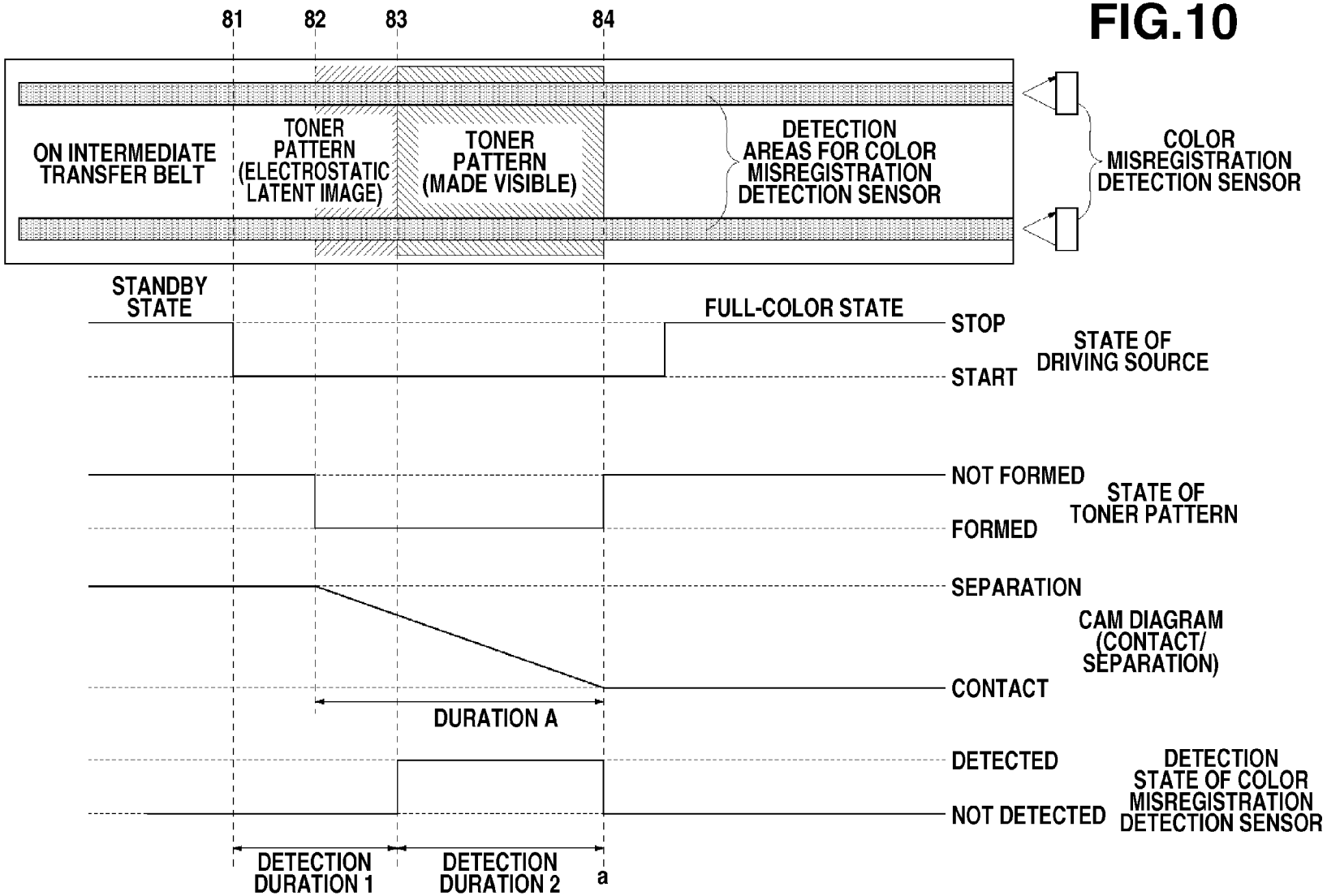
FIG. 10 is a timing chart illustrating a method for detecting contact timing.

A method for detecting contact timing will be described below with reference to the timing chart of FIG. 10. At timing 81, a signal for starting driving the contact/separation motor 31 is output, and an electrostatic latent image of toner pattern starts being formed on the photosensitive drum 1. At timing 82, the development roller 3 contacts the photosensitive drum 1 by driving the contact/separation motor 31, and the electrostatic latent image of toner pattern on the photosensitive drum 1 is made visible. The visible toner pattern is transferred onto the intermediate transfer belt 8 and, at timing 83, detected by the color misregistration detection sensor 27.

A duration between timing 81 at which the contact/separation motor 31 is started and timing 83 at which the color misregistration detection sensor 27 starts detecting the toner pattern is referred to as a detection duration 1 which serves as the above-mentioned contact margin. The driving speed of the contact/separation motor 31 is controlled according to the detection duration 1. A method for controlling the driving speed of the contact/separation motor 31 from the detection duration 1 will be described below in detail.

A duration between timing 83 at which the color misregistration detection sensor 27 starts detecting the toner pattern and timing 84 at which it can no longer detect the toner pattern is referred to as a detection duration 2. During the detection duration 2, contact between the development roller 3 and the photosensitive drum 1 is established, and an image is formed on the intermediate transfer belt 8. The detection duration 2 serves as a guaranteed image region where image formation is guaranteed.

Figure 11A:
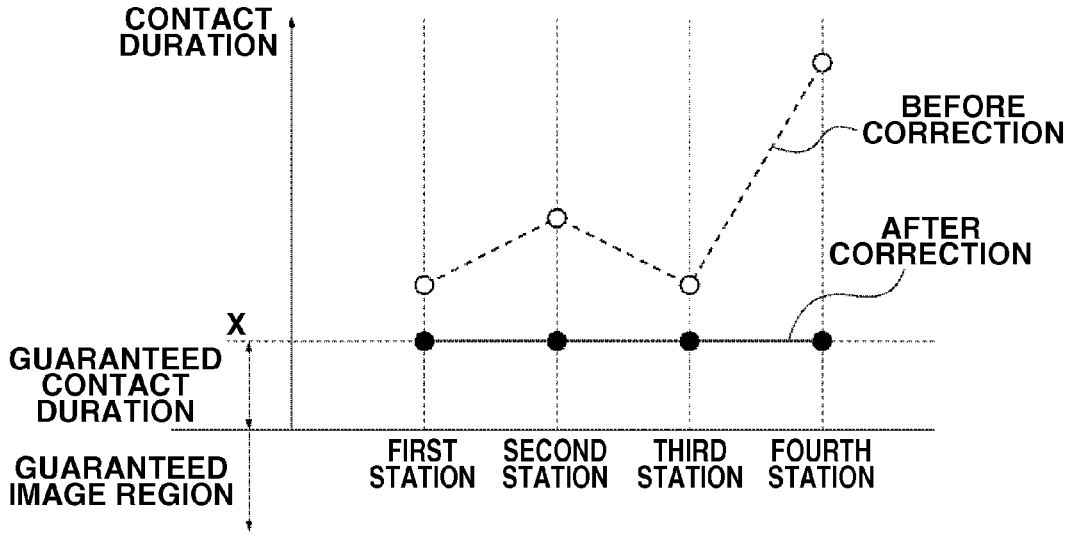
FIG. 11A illustrates a contact duration at each station.
Figure 11B:
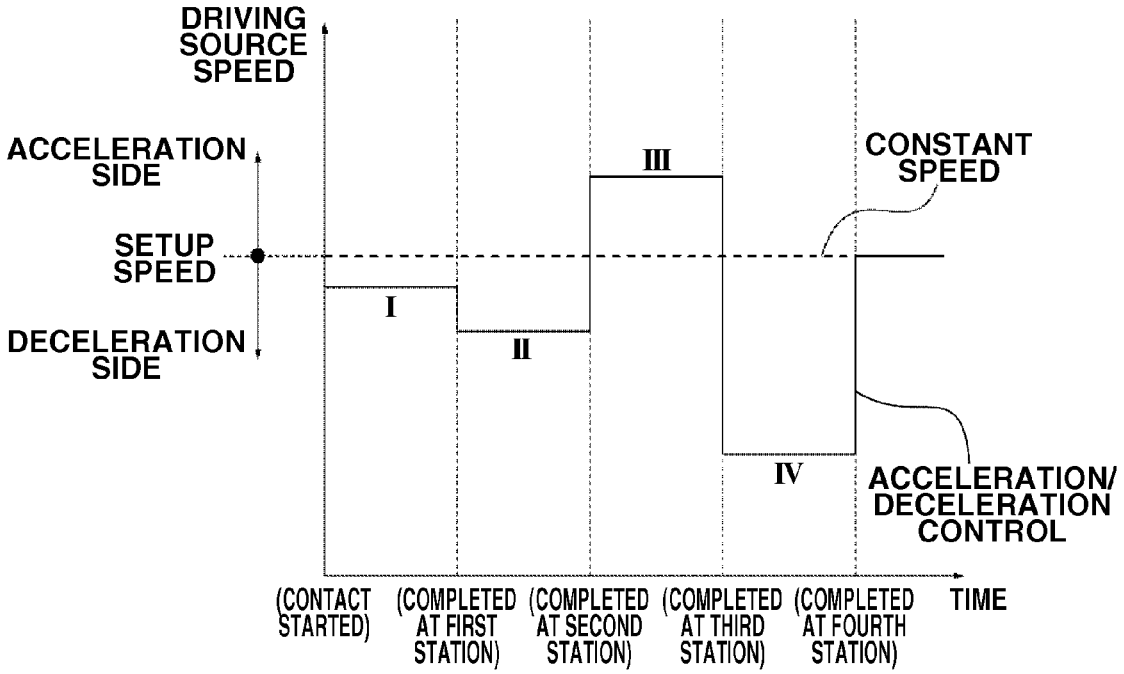
FIG. 11B illustrates acceleration/deceleration control for a contact/separation motor.

A method for controlling the driving speed of the contact/separation motor 31 to attain a contact duration suitable for each station based on the detected contact duration will be described below with reference to FIGS. 11A and 11B. The contact duration is a period from the time when the contact/separation motor 31 starts to be driven to the time when the development roller 3 and the photosensitive drum 1 contact each other. Referring to the graph of FIG. 11A, the dotted line denotes durations of contact between the development roller 3 and the photosensitive drum 1 when the contact/separation motor 31 is driven at a constant speed and contact timings are detected. Variation in contact duration between stations are caused by variation in accuracy of attachment of the process cartridges to the image forming apparatus as well as variation in control of the contact/separation motor 31. If contact between the development roller 3 and the photosensitive drum 1 is established before the guaranteed image domain, their lifetime will be shortened by friction. Therefore, the driving speed of the contact/separation motor 31 is controlled so as to prevent variation between stations. The guaranteed contact duration (X) is provided before the guaranteed image domain in consideration of variation in control of the contact/separation motor 31. Hence, it is necessary to provide a fixed guaranteed contact duration (X) from the guaranteed image domain. However, when there is no influence of variation in control of the contact/separation motor 31, the guaranteed contact duration (X) does not need to be provided. The length of the guaranteed contact duration (X) can be suitably set in association with variation in control of the contact/separation motor 31.

When a contact duration is detected at each station as illustrated by the dotted line in FIG. 11A, the contact/separation motor 31 is controlled as follows: With the first station, since the contact duration is longer than the guaranteed contact duration (X) provided from the guaranteed image domain, the contact/separation motor 31 is decelerated less than the setup speed during a duration between the time when contact is started and the time when contact is completed at the first station as denoted by the solid line I in FIG. 11B. With the second station, since the contact duration is longer than that of the first station, the contact/separation motor 31 is decelerated less than the setup speed during a duration between the time when contact is completed at the first station and the time when contact is completed at the second station as denoted by the solid line II in FIG. 11B. With the third station, since the contact duration is shorter than that of the second station, the contact/separation motor 31 is accelerated more than the setup speed during a duration between the time when contact is completed at the second station and the time when contact is completed at the third station as denoted by the solid line III in FIG. 11B. With the fourth station, since the contact duration is longer than that of the third station, the contact/separation motor 31 is decelerated less than the setup speed during a duration between the time when contact is completed at the third station and the time when contact is completed at the fourth station as denoted by the solid line IV in FIG. 11B. The driving speed of the contact/separation motor 31 is controlled at each station in this way because it controls the drive of all of the stations as a single driving source.

A method for correcting the contact duration at each station will be described below with reference to FIGS. 12A to 12D. The driving frequency of the contact/separation motor 31 for contact timing detection is 1200 pulses/second (hereinafter referred to as pps), and the guaranteed contact duration (X) is corrected to 50 ms. Contact durations of the four stations, Ty1, Tm1, Tc1, and Tk1, are as follows:

Ty1: 80 msec.
Tm1: 150 msec.
Tc1: 80 msec.
Tk1: 200 msec.

Since the guaranteed contact duration (X) is set to 50 ms, actual correction amounts of contact duration, Ty2, Tm2, Tc2, and Tk2, are as follows:

Ty2: 30 msec.
Tm2: 100 msec.
Tc2: 30 msec.
Tk2: 150 msec.

Since the contact/separation motor 31 drives all of the stations as a single driving source, correction amounts for preceding (upstream-side) stations are added to the result of correction at each station as follows:

Total correction amount for the first station: Ty2
Total correction amount for the second station: Ty2+Tm2
Total correction amount for the third station: Ty2+Tm2+Tc2
Total correction amount for the fourth station: Ty2+Tm2+Tc2+Tk2

A method for controlling the contact duration at each station will be described below with reference to the above-mentioned relations and the graphs of FIGS. 12A to 12D.

Firstly, the contact duration of the first station will be corrected with reference to FIG. 12A. With the first station, since contact is established 30 ms longer than the guaranteed contact duration (X), the contact/separation motor 31 is decelerated to match the contact duration of the first station with the guaranteed contact duration (X). Since the contact/separation motor 31 drives all of the stations as a single driving source, correcting the contact duration of the first station by 30 ms also corrects those of the second, third, and fourth stations by 30 ms.

The contact duration of the second station will be corrected with reference to FIG. 12B. With the second station, since contact is established 70 ms longer than the guaranteed contact duration (X) due to contact duration correction at the first station, the contact/separation motor 31 is decelerated to match the contact duration of the second station with the guaranteed contact duration (X). Since the contact/separation motor 31 drives all of the stations as a single driving source, correcting the contact duration of the second station by 70 ms also corrects those of the third and fourth stations by 70 ms.

The contact duration of the third station will be corrected with reference to FIG. 12C. With the third station, contact is established 70 ms shorter than the guaranteed contact duration (X) due to contact duration correction at the first and second stations. A decrease in contact duration may disable performing image formation in the guaranteed image domain. Therefore, the contact/separation motor 31 is accelerated to match the contact duration of the third station with the guaranteed contact duration (X). Since the contact/separation motor 31 drives all of the stations as a single driving source, correcting the contact duration of the third station by −70 ms also corrects that of the fourth station by −70 ms.

The contact duration of the fourth station will be corrected with reference to FIG. 12D. With the fourth station, since contact is established 120 ms longer than the guaranteed contact duration (X) due to contact duration correction at the first, second, and third stations, the contact/separation motor 31 is decelerated to match the contact duration of the fourth station with the guaranteed contact duration (X).

Figure 13A:
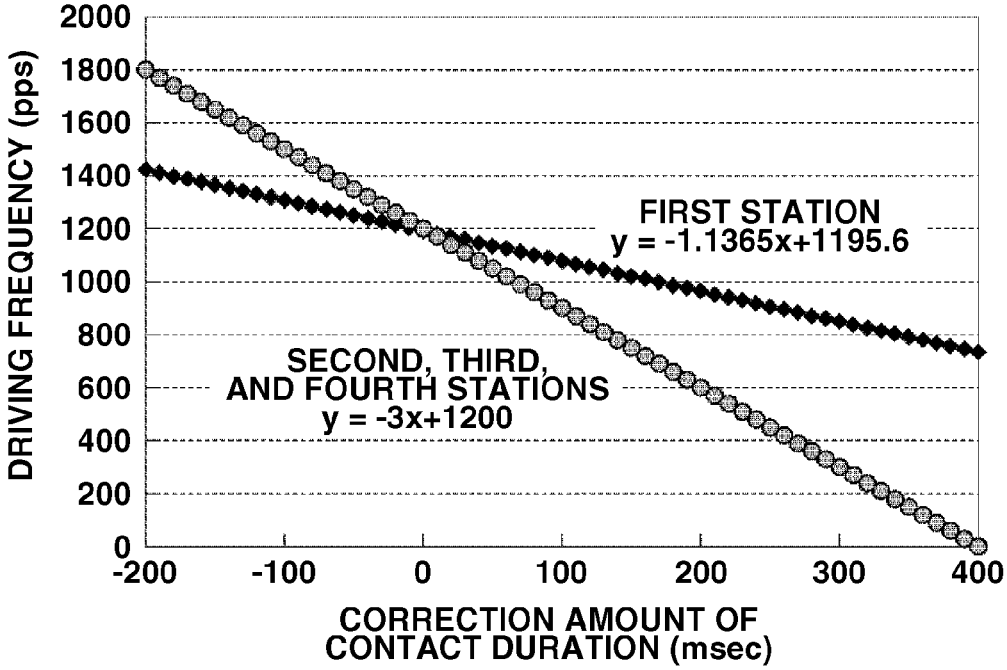
FIG. 13A illustrates a relation between the driving frequency of the contact/separation motor and the correction amount of contact duration.
Figure 13B:
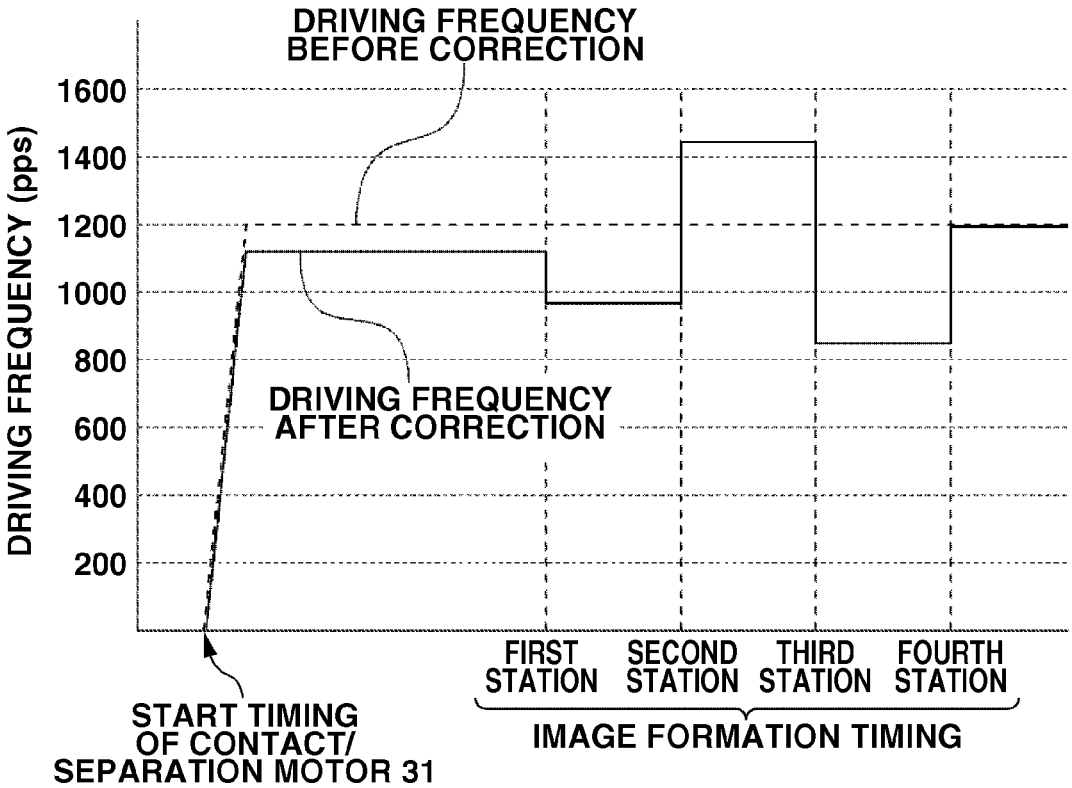
FIG. 13B illustrates the driving frequency with time.

FIG. 13A illustrates a relation between the driving frequency of the contact/separation motor 31 and the correction amount of contact duration, and FIG. 13B illustrates the driving frequency with time. With the configuration according to the present exemplary embodiment, a relation between the driving frequency of the contact/separation motor 31 and the correction amount of contact duration differs between the first station and the second to fourth stations. This is because a duration between image formations at the first, second, third, and fourth stations (about 400 ms) is shorter than a duration between the time when the contact/separation motor 31 is started and the time when image formation is performed at the first station (about 1350 ms). FIG. 13A illustrates a relation between the driving frequency of the contact/separation motor 31 and the correction amount of contact duration. At an identical driving frequency, the correction amounts for the second, third, and fourth stations are smaller than that for the first station. A method for determining the driving frequency of the contact/separation motor 31 in FIG. 13B will be described below with reference to FIGS. 12A to 12D and 13A. With the first station, the correction amount of contact duration is 30 ms, and the driving frequency of the contact/separation motor 31 can be obtained as 1160 pps (approximated value) by assigning x=30 to formula (1):

$$y=-1.1365*x+1195.6 \quad (1)$$

With the second, third, and fourth stations, the driving frequency of the contact/separation motor 31 can be obtained by assigning a correction amount for each station to formula (2) (for calculating the driving frequencies of the second, third, and fourth stations):

$$y=-3*x+1200 \quad (2)$$

With the second station, the correction amount of contact duration is 70 ms, and the driving frequency is 990 pps. With the third station, the correction amount of contact duration is −70 ms, and the driving frequency is 1410 pps. With the fourth station, the correction amount of contact duration is 120 ms, and the driving frequency is 840 pps.

The contact duration can be controlled by accelerating or decelerating the contact/separation motor 31 at each station in this way. This control enables shortening unnecessary durations of contact between the development roller 3 and the photosensitive drum 1, thus alleviating the shortening of the lifetime of the development rollers 3 and photosensitive drums 1.

Figure 14:
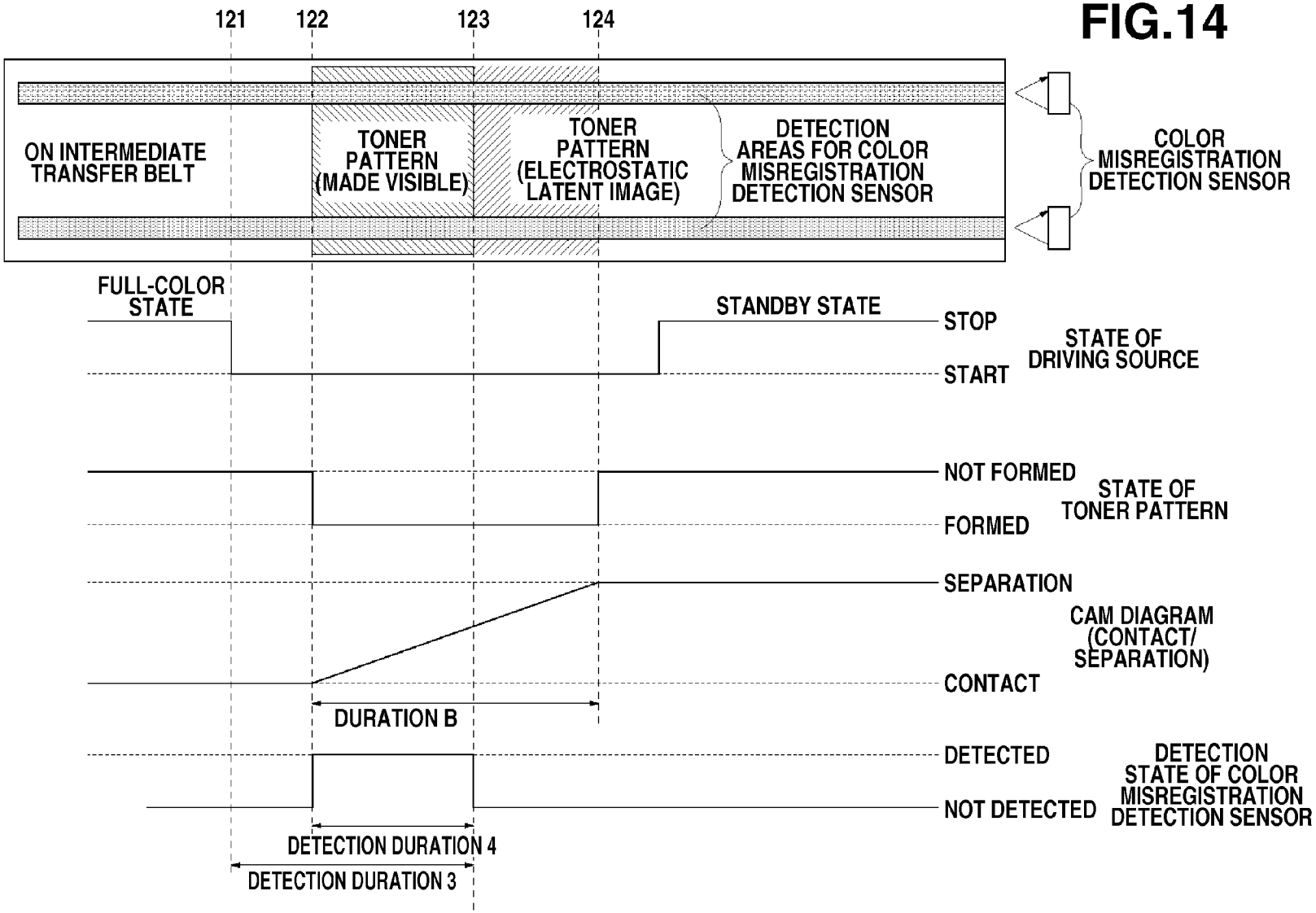
FIG. 14 is a timing chart illustrating a method for detecting separation timing.

A method for detecting separation timing will be described below with reference to FIG. 14. Since separation timing detection is performed after contact timing detection, separation timing detection is started from a contact state between the development roller 3 and the photosensitive drum 1.

At timing 121, a signal for starting driving the contact/separation motor 31 is output, an electrostatic latent image of toner pattern starts being formed on the photosensitive drum 1, and separation between the development roller 3 and the photosensitive drum 1 is started. At timing 122, the toner pattern formed on the photosensitive drums 1 is transferred onto the intermediate transfer belt 8, and detected by the color misregistration detection sensor 27. At timing 123, separation between the development roller 3 and the photosensitive drum 1 is established, the toner pattern is made visible, and the color misregistration detection sensor 27 completes detection of the toner pattern on the intermediate transfer belt 8. At timing 124, separation between the development roller 3 and the photosensitive drum 1 is completed, and formation of an electrostatic latent image of toner pattern is ended. Formation of an electrostatic latent image is performed during the duration B in FIG. 14.

A duration between timing 121 at which the contact/separation motor 31 is started and timing 123 at which the color misregistration detection sensor 27 can no longer detect the toner pattern is referred to as a detection duration 3. The driving speed of the contact/separation motor 31 is controlled according to the detection duration 3. A method for controlling the driving speed of the contact/separation motor 31 from the detection duration 3 will be described below in detail.

A duration between timing 122 at which the color misregistration detection sensor 27 starts detecting the toner pattern and timing 123 at which it can no longer detect the toner pattern is referred to as a detection duration 4. During the detection duration 4, contact between the development roller 3 and the photosensitive drum 1 is established, and an image is formed on the intermediate transfer belt 8. The detection duration 4 serves as a guaranteed image region where image formation is guaranteed.

Figure 15A:
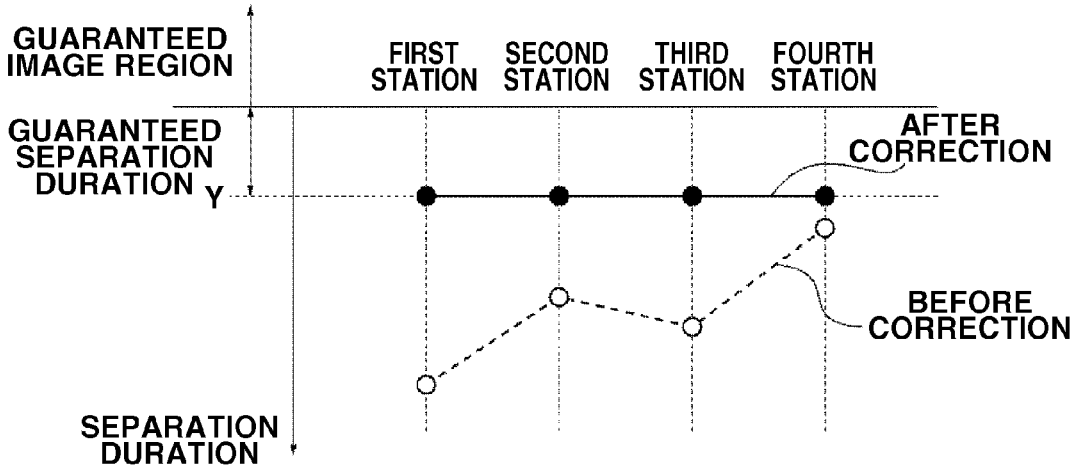
FIG. 15A illustrates a separation duration at each station.
Figure 15B:
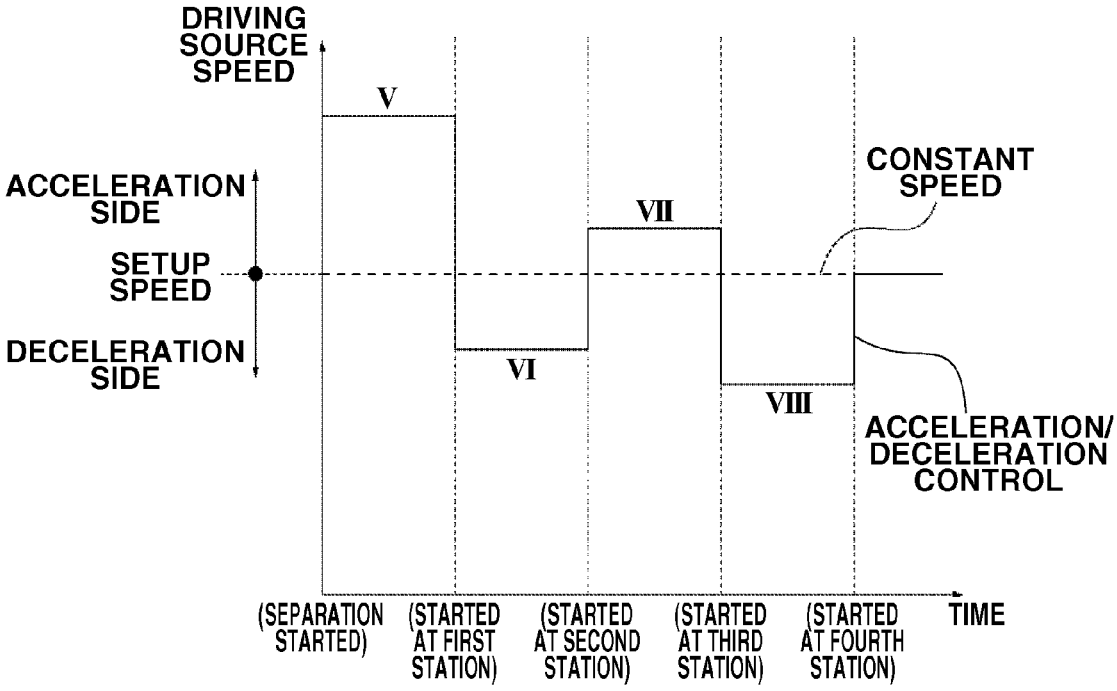
FIG. 15B illustrates acceleration/deceleration control for the contact/separation motor.

A method for controlling the driving speed of the contact/separation motor 31 to attain a separation duration suitable for each station based on the detected separation duration will be described below with reference to FIGS. 15A and 15B. The separation duration refers to a time duration between the time when the contact/separation motor 31 is started for separation and the time when the state between the development roller 3 and the photosensitive drum 1 is changed from contact to separation. Referring to the graph of FIG. 15A, the dotted line denotes durations of separation between the development roller 3 and the photosensitive drum 1 when the contact/separation motor 31 is driven at a constant speed and separation timings are detected. Variation in separation duration between stations is caused by variation in accuracy of attachment of the process cartridges to the image forming apparatus as well as variation in control of the contact/separation motor 31. If contact between the development roller 3 and the photosensitive drum 1 is established after the guaranteed image domain, their lifetime will be shortened by friction. Therefore, the driving speed of the contact/separation motor 31 is controlled to prevent variation between stations. Similar to the above-mentioned contact state, the guaranteed separation duration (Y) is provided before the guaranteed image domain in consideration of variation in control of the contact/separation motor 31. Therefore, it is necessary to provide a certain guaranteed separation duration (Y) from the guaranteed image domain. However, when there is no influence of variation in control of the contact/separation motor 31, the separation guaranteed separation duration (Y) does not need to be provided. The length of the guaranteed separation duration (Y) can be suitably set in association with variation in control of the contact/separation motor 31.

When a separation duration is detected at each station as illustrated by the dotted line in FIG. 15A, the contact/separation motor 31 is controlled as follows: With the first station, since the separation duration is longer than the guaranteed separation duration (Y) provided from the guaranteed image domain, the contact/separation motor 31 is accelerated more than the setup speed during a duration between the time when separation is started and the time when separation is completed at the first station as denoted by the solid line V in FIG. 15B. With the second station, since the separation duration is shorter than that of the first station, the contact/separation motor 31 is decelerated less than the setup speed during a duration between the time when separation is completed at the first station and the time when separation is completed at the second station as denoted by the solid line VI in FIG. 15B. With the third station, since the separation duration is longer than that of the second station, the contact/separation motor 31 is accelerated more than the setup speed during a duration between the time when separation is completed at the second station and the time when separation is completed at the third station as denoted by the solid line VII in FIG. 15B. With the fourth station, since the separation duration is shorter than that of the third station, the contact/separation motor 31 is decelerated less than the setup speed during a duration between the time when separation is completed at the third station and the time when separation is completed at the fourth station as denoted by the solid line VIII in FIG. 15B. The driving speed of the contact/separation motor 31 is controlled at each station in this way because it controls the drive of all of the stations as a single driving source.

A method for correcting the separation duration at each station will be described below with reference to FIGS. 16A to 16D. The driving frequency of the contact/separation motor 31 for separation timing detection is 1200 pulses/second similar to the case of contact timing detection mentioned above, and the guaranteed separation duration (Y) is corrected to 50 ms. Separation durations of the four stations, Ty3, Tm3, Tc3, and Tk3, are as follows:

Ty3: 150 msec.
Tm3: 110 msec.
Tc3: 170 msec.
Tk3: 70 msec.

Since the guaranteed separation duration (Y) is set to 50 ms, actual correction amounts of separation duration, Ty4, Tm4, Tc4, and Tk4, are as follows:

Ty4: 100 msec.
Tm4: 60 msec.
Tc4: 120 msec.
Tk4: 20 msec.

Since the contact/separation motor 31 drives all of the stations as a single driving source, correction amounts for preceding (upstream-side) stations are added to the result of correction at each station as follows:

Total correction amount for the first station: Ty4
Total correction amount for the second station: Ty4+Tm4
Total correction amount for the third station: Ty4+Tm4+Tc4
Total correction amount for the fourth station: Ty4+Tm4+Tc4+Tk4

A method for controlling the separation duration at each station will be described below with reference to the above-mentioned relations and the graphs of FIGS. 16A to 16D. Firstly, the separation duration of the first station will be corrected with reference to FIG. 16A. With the first station, since contact is established 100 ms longer than the guaranteed separation duration (Y), the contact/separation motor 31 is accelerated to match the separation duration of the first station with the guaranteed separation duration (Y). Since the contact/separation motor 31 drives all of the stations as a single driving source, correcting the separation duration of the first station by 100 ms also corrects those of the second, third, and fourth stations by 100 ms.

The separation duration of the second station will be corrected with reference to FIG. 16B. With the second station, contact is established −40 ms shorter than the guaranteed separation duration (Y) due to separation duration correction at the first station. A decrease in separation duration may disable performing image formation in the guaranteed image domain. Therefore, the contact/separation motor 31 is decelerated to match the separation duration of the second station with the guaranteed separation duration (Y). Since the contact/separation motor 31 drives all of the stations as a single driving source, correcting the separation duration of the second station by −40 ms also corrects those of the third and fourth stations by −40 ms.

The separation duration of the third station will be corrected with reference to FIG. 16C. With the third station, since contact is established 60 ms longer than the guaranteed separation duration (Y) due to separation duration correction at the first and second stations, the contact/separation motor 31 is accelerated to match the separation duration of the third station with the guaranteed separation duration (Y). Since the contact/separation motor 31 drives all of the stations as a single driving source, correcting the separation duration of the third station by 60 ms also corrects that of the fourth station by 60 ms.

The separation duration of the fourth station will be corrected with reference to FIG. 16D. With the fourth station, contact is established −100 ms shorter than the guaranteed separation duration (Y) due to separation duration correction at the first, second and third stations. A decrease in separation duration may disable performing image formation in the guaranteed image domain. Therefore, the contact/separation motor 31 is decelerated to match the separation duration of the fourth station with the guaranteed separation duration (Y).

Figure 17:
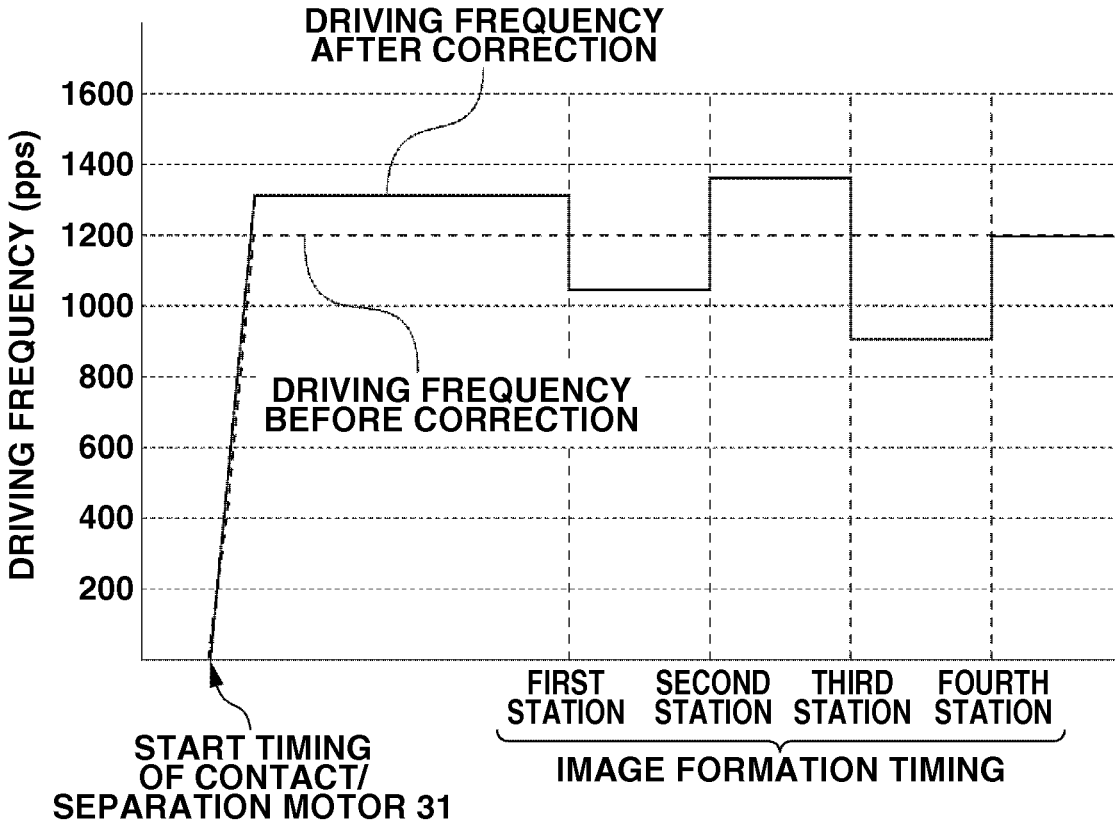
FIG. 17 is a graph illustrating the driving frequency of the contact/separation motor with time after separation duration correction according to separation timing.

FIG. 17 is a graph illustrating the driving frequency of the contact/separation motor 31 with time after separation duration correction according to separation timing. Similar to the above-mentioned contact timing, a duration between image formations at the first, second, third, and fourth stations (about 400 ms) is shorter than a duration between the time when the contact/separation motor 31 is started and the time when image formation is performed at the first station (about 1350 ms). A method for determining the driving frequency of the contact/separation motor 31 in FIG. 17 will be described below with reference to FIGS. 13A and 16A to 16D. With the first station, the correction amount of separation duration is 100 ms, and the driving frequency of the contact/separation motor 31 can be obtained as 1310 pps (approximated value) by assigning x=−100 to formula (1).

With the second, third, and fourth stations, the driving frequency of the contact/separation motor 31 can be obtained by assigning a correction amount for each station to x in formula (2) (for calculating the driving frequencies of the second, third, and fourth stations). With the second station, the correction amount of separation duration is −40 ms, and the driving frequency is 1080 pps. With the third station, the correction amount of separation duration is 60 ms, and the driving frequency is 1380 pps. With the fourth station, the correction amount of separation duration is −100 ms, and the driving frequency is 900 pps.

The present exemplary embodiment has specifically been described based on a case where durations of contact between the photosensitive drum 1 and the development roller 3 are controlled according to the guaranteed image domain. However, contact duration control is not limited to the guaranteed image domain. For example, when an image size for respective colors is received from a controller, contact durations can also be optimally controlled according to the image size for respective colors. Controlling contact durations according to the image size for respective colors enables reducing wear of the photosensitive drums 1 and the development rollers 3. In addition, similar to contact durations, separation durations can also been controlled according to the image size.

The separation duration can be controlled by accelerating or decelerating the contact/separation motor 31 at each station in this way. This control enables shortening unnecessary durations of contact between the development roller 3 and the photosensitive drum 1, thus alleviating the shortening of their lifetime.

The first exemplary embodiment has specifically been described based on acceleration/deceleration control for the contact/separation motor 31 in association with the result of contact/separation timing detection. A second exemplary embodiment of the present invention will be described below based on a method for decelerating the contact/separation motor 31, after contact/separation timing detection, to control contact and separation durations. The first exemplary embodiment has specifically been described based on a case where the contact/separation motor 31 is accelerated. In other words, a costly motor needs to be used as the contact/separation motor 31 in the first exemplary embodiment. However, since the output torque of a motor decreases with increasing driving speed, required motor specifications (which guarantee the output torque at high speeds) will become severer.

Therefore, as an example of optimization without raising the specifications of the contact/separation motor 31, the present exemplary embodiment will be described below based on a method for controlling contact and separation operations by using a low-cost motor. Descriptions on the same configuration as the first exemplary embodiment will be omitted.

Figure 18A:
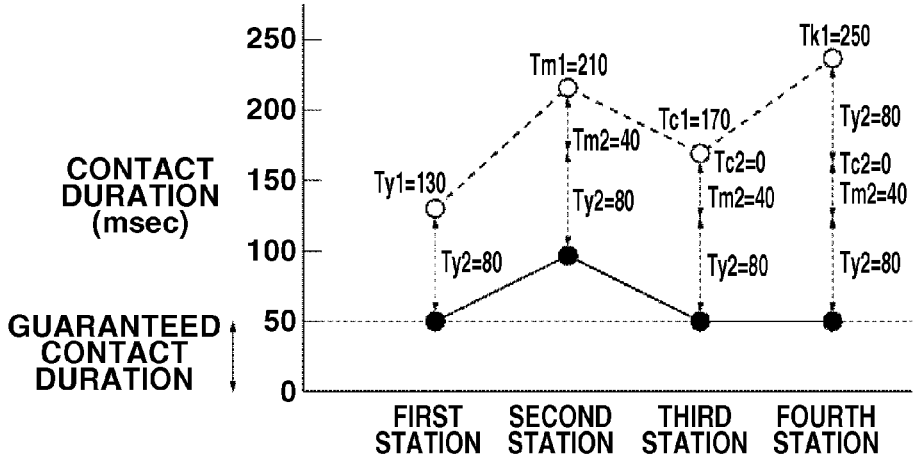
FIG. 18A illustrates a contact duration at each station.

A method for controlling the driving speed of the contact/separation motor 31 to attain a contact duration suitable for each station based on the detected contact duration will be described below with reference to FIGS. 18A and 18B. Referring to the graph of FIG. 18A, the dotted line denotes durations of contact between the development roller 3 and the photosensitive drum 1 when the contact/separation motor 31 are driven at the specified maximum driving speed and contact timings are detected. The driving frequency of the contact/separation motor 31 at the time of contact duration detection is 1200 pps, and the maximum driving frequency at which it is operative is also 1200 pps. Therefore, the guaranteed contact duration (X) is suitably controlled at driving speeds not exceeding the maximum driving frequency (1200 pps) of the contact/separation motor 31. Similar to the first exemplary embodiment, the guaranteed contact duration (X) is 50 ms. However, when there is no influence of variation in control of the contact/separation motor 31, the guaranteed contact duration (X) does not need to be provided. The length of the guaranteed contact duration (X) can be suitably set in association with variation in control of the contact/separation motor 31.

When a contact duration is detected at each station as illustrated by the dotted line in FIG. 18A, the contact/separation motor 31 is controlled as follows: With the first station, since the contact duration is longer than the guaranteed contact duration (X) provided from the guaranteed image domain, the contact/separation motor 31 is decelerated less than the setup speed during a duration between the time when contact is started and the time when contact is completed at the first station as denoted by the solid line I in FIG. 18B. With the second station, since the contact duration is longer than that of the first station, the contact/separation motor 31 is decelerated less than the setup speed during a duration between the time when contact is completed at the first station and the time when contact is completed at the second station as denoted by the solid line II in FIG. 18B. At this time, the contact duration of the second station is longer than the guaranteed contact duration (X). This is because the contact/separation motor 31 cannot be accelerated more than the setup speed, and accordingly because decelerating the contact/separation motor 31 so that contact is established with the length of the guaranteed contact duration (X) at the second station will affect the third and fourth stations disabling providing the guaranteed contact duration (X). Concrete numerical values will be described below.

Figure 18B:
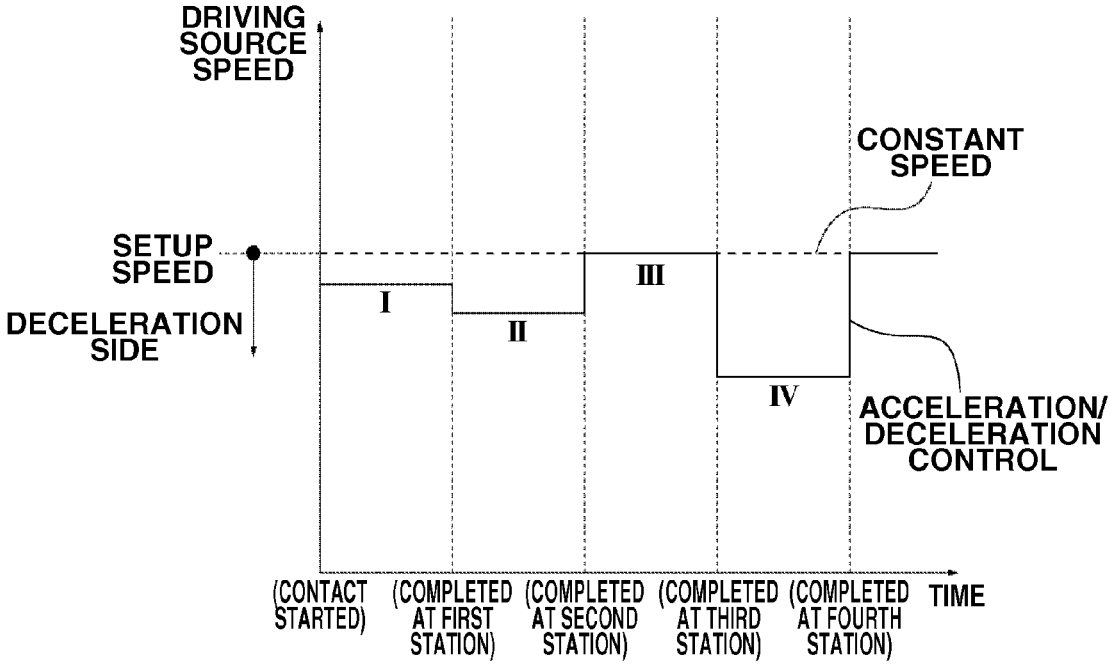
FIG. 18B illustrates acceleration/deceleration control for a contact/separation motor.

With the third station, since the contact duration is shorter than that of the second station, the contact/separation motor 31 is accelerated during a time between the time when contact is completed at the second station and the time when contact is completed at the third station as denoted by the solid line III in FIG. 18B. However, the contact/separation motor 31 can be accelerated up to the setup speed. With the fourth station, since the contact duration is longer than that of the third station, the contact/separation motor 31 is decelerated less than the setup speed during a duration between the time when contact is completed at the third station and the time when contact is completed at the fourth station as denoted by the solid line IV in FIG. 18B. The driving speed of the contact/separation motor 31 is controlled at each station in this way because it controls the drive of all of the stations as a single driving source.

A method for setting the driving speed of the contact/separation motor 31 at each station will be described below with reference to FIG. 18A. Contact durations of the four stations, Ty1, Tm1, Tc1, and Tk1, are as follows:

Ty1: 130 msec.
Tm1: 210 msec.
Tc1: 170 msec.
Tk1: 250 msec.

Since the guaranteed contact duration (X) is set to 50 ms, actual correction amounts of contact duration for the four stations, Ty2, Tm2, Tc2, and Tk2, are as follows:

Ty2: 80 msec.
Tm2: 160 msec.
Tc2: 170 msec.
Tk2: 180 msec.

Since the contact/separation motor 31 drives all of the stations as a single driving source, correction amounts for preceding (upstream-side) stations are added to the result of correction at each station as follows:

Total correction amount for the first station: Ty2
Total correction amount for the second station: Ty2+Tm2
Total correction amount for the third station: Ty2+Tm2+Tc2
Total correction amount for the fourth station: Ty2+Tm2+Tc2+Tk2

A method for controlling the contact duration at each station will be described below with reference to the above-mentioned relations and FIG. 18A. Firstly, the contact duration of the first station will be corrected. With the first station, since contact is established 80 ms longer than the guaranteed contact duration (X), the contact/separation motor 31 is decelerated to match the contact duration of the first station with the guaranteed contact duration (X). Since the contact/separation motor 31 drives all of the stations as a single driving source, correcting the contact duration of the first station by 80 ms also corrects those of the second, third, and fourth stations by 80 ms.

The contact duration of the second station will be corrected. With the second station, since contact is established 80 ms longer than the guaranteed contact duration (X) due to contact duration correction at the first station, the contact/separation motor 31 is decelerated so that contact is established 40 ms longer than the guaranteed contact duration (X). The above-mentioned control is performed because of the following reason. Since the contact/separation motor 31 drives all of the stations as a single driving source, correcting the contact duration up to the guaranteed contact duration (X) at the second station will disable suitably correcting the third and fourth stations on the downstream side of the second station. Therefore, contact durations are controlled so that the contact duration of a preceding (upstream-side) station having the shortest one does not fall below a predetermined value, i.e., the guaranteed contact duration (X). In this case, since the contact duration of the second station is corrected by 40 ms so that the contact duration of the third station coincides with the guaranteed contact duration (X), the contact durations of the third and fourth stations are also corrected by 40 ms.

The contact duration of the third station will be corrected. With the third station, since contact is established for the guaranteed contact duration (X) due to contact duration correction at the first and the second stations, the contact/separation motor 31 is driven at the setup speed and therefore contact duration correction is not performed.

The contact duration of the fourth station will be corrected. With the fourth station, since contact is established 80 ms longer than the guaranteed contact duration (X) due to contact duration correction at the first, second, and third stations, the contact/separation motor 31 is decelerated to match the contact duration of the fourth station with the guaranteed contact duration (X).

Figure 19:
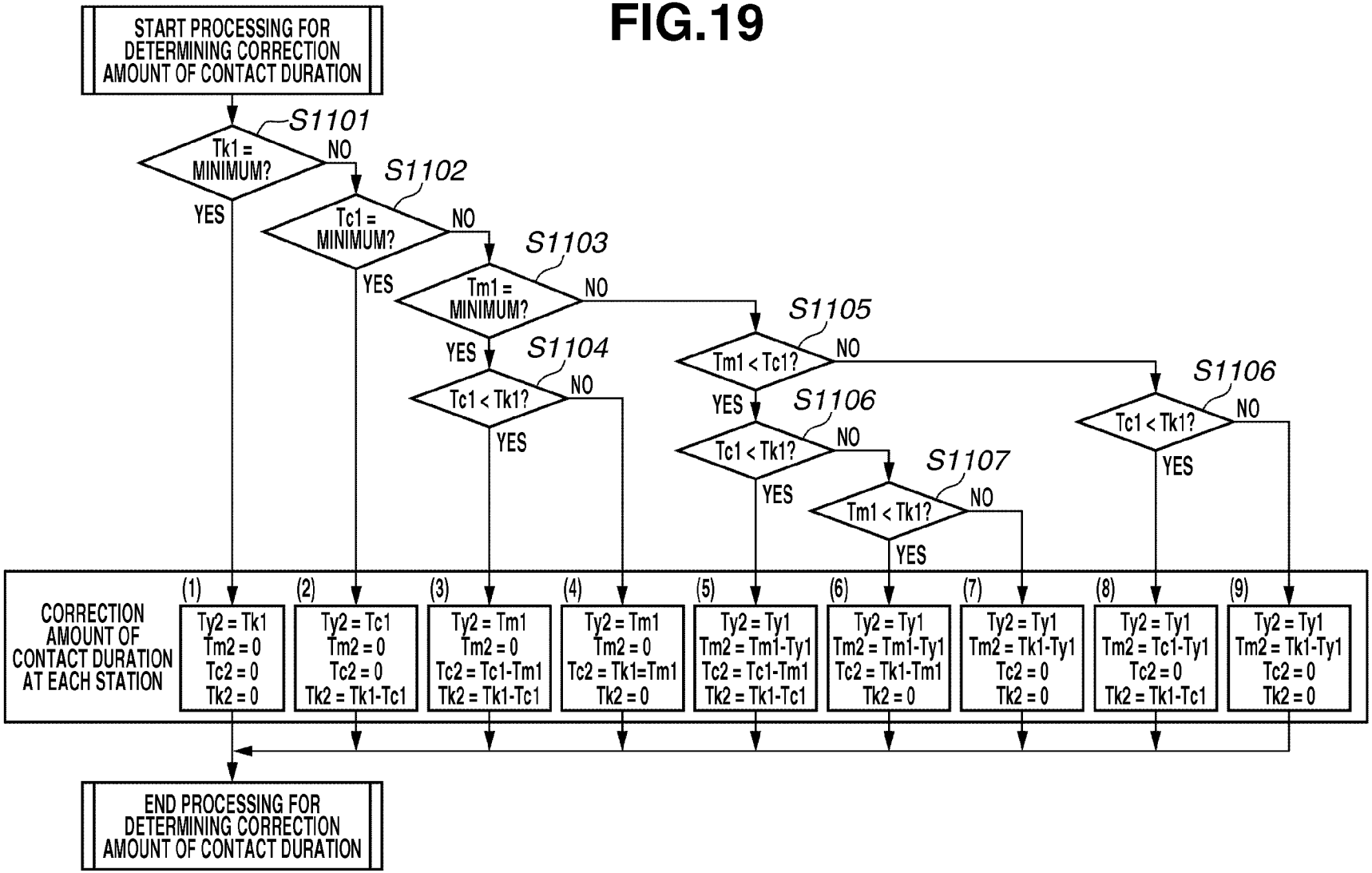
FIG. 19 is a flow chart illustrating a relation between a contact duration at each station and driving speed control for the contact/separation motor.

When the maximum driving speed of the contact/separation motor 31 is predetermined in specifications and hence its driving speed cannot be accelerated more than the setup speed, contact durations of the four stations are compared and suitably controlled so that the contact durations do not fall below the guaranteed setup duration (X). FIG. 19 is a flow chart illustrating a relation between the contact duration of each station and driving speed control for the contact/separation motor 31.

Referring to FIG. 19, in step S1101, the CPU 26 determines whether the contact duration Tk1 is minimum. If the contact duration Tk1 is minimum, the CPU 26 sets the correction amounts of contact duration at the respective image forming stations as Ty2=Tk1, Tm2=0, Tc2=0, and Tk2=0. If the contact duration Tk1 is not minimum, the processing proceeds to step S1102. In step S1102, the CPU 26 determines whether the contact duration Tc1 is minimum. If the contact duration Tc1 is minimum, the CPU 26 sets the correction amounts of contact duration at the respective image forming stations as Ty2=Tc1, Tm2=0, Tc2=0, and Tk2=Tk1−Tc1. If the contact duration Tk1 is not minimum, the processing proceeds to step S1103.

In step S1103, the CPU 26 determines whether the contact duration Tm1 is minimum. If the contact duration Tm1 is minimum, the processing proceeds to step S1104. If the contact duration Tm1 is not minimum, the processing proceeds to step S1105. In step S1104, the CPU 26 determines whether the contact duration Tk1 is greater than the contact duration Tc1. If the contact duration Tk1 is greater than the contact duration Tc1, the CPU 26 sets the correction amounts of contact duration at the respective image forming stations as Ty2=Tm1, Tm2=0, Tc2=Tc1−Tm1, and Tk2=Tk1−Tc1. If the contact duration Tk1 is not greater than the contact duration Tc1, the CPU 26 sets the correction amounts of contact duration at the respective image forming stations as Ty2=Tm1, Tm2=0, Tc2=Tk1−Tm1, and Tk2=0.

In step S1105, the CPU 26 determines whether the contact duration Tc1 is greater than the contact duration Tm1. If the contact duration Tc1 is greater than the contact duration Tm1, the processing proceeds to step S1106. If the contact duration Tc1 is not greater than the contact duration Tm1, the processing proceeds to step S1108. In step S1106, the CPU 26 determines whether the contact duration Tk1 is greater than the contact duration Tc1. If the contact duration Tk1 is greater than the contact duration Tc1, the CPU 26 sets the correction amounts of contact duration at the respective image forming stations as Ty2=Ty1, Tm2=Tm1−Ty1, Tc2=Tc1−Tm1, and Tk2=Tk1−Tc1. If the contact duration Tk1 is not greater than the contact duration Tc1, the processing proceeds to step S1107. In step S1107, the CPU 26 determines whether the contact duration Tk1 is greater than the contact duration Tm1. If the contact duration Tk1 is greater than the contact duration Tm1, the CPU 26 sets the correction amounts of contact duration at the respective image forming stations as Ty2=Ty1, Tm2=Tm1−Ty1, Tc2=Tk1−Tm1, and Tk2=0. If the contact duration Tk1 is not greater than the contact duration Tm1, the CPU 26 sets the correction amounts of contact duration at the respective image forming stations as Ty2=Ty1, Tm2=Tk1−Ty1, Tc2=0, and Tk2=0.

In step S1108, the CPU 26 determines whether the contact duration Tk1 is greater than the contact duration Tc1. If the contact duration Tk1 is greater than the contact duration Tc1, the CPU 26 sets the correction amounts of contact duration at the respective image forming stations as Ty2=Ty1, Tm2=Tc1−Ty1, Tc2=0, and Tk2=Tk1−Tc1. If the contact duration Tk1 is not greater than the contact duration Tc1, the CPU 26 sets the correction amounts of contact duration at the respective image forming stations as Ty2=Ty1, Tm2=Tk1−Ty1, Tc2=0, and Tk2=0.

Figure 20A:
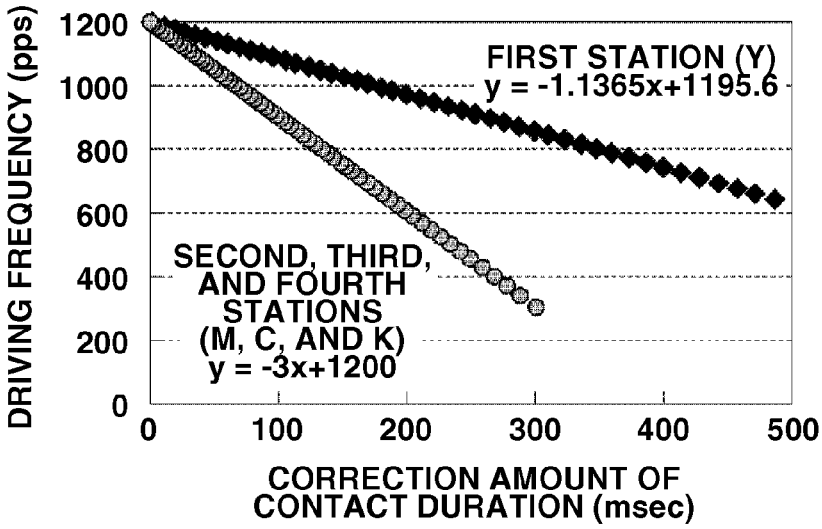
FIG. 20A illustrates a relation between the driving frequency of the contact/separation motor and the correction amount of contact duration.
Figure 20B:
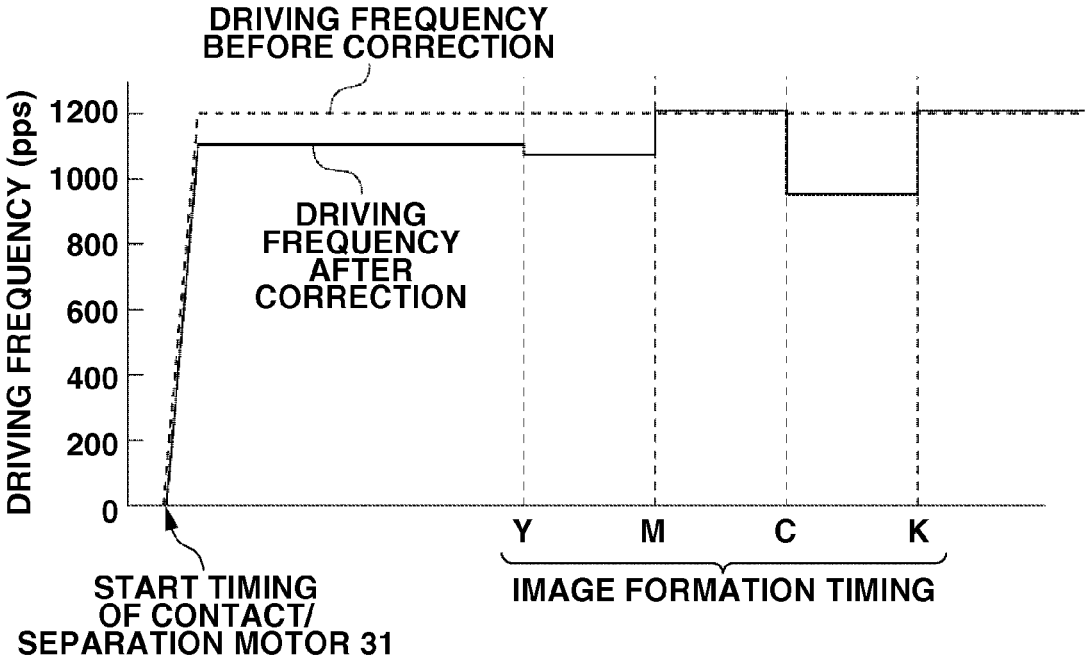
FIG. 20B illustrates the driving frequency with time.

FIG. 20A illustrates a relation between the driving frequency of the contact/separation motor 31 and the correction amount of contact duration. Similar to the first exemplary embodiment, a relation between the driving frequency of the contact/separation motor 31 and the correction amount of contact duration differs between the first station and the second to fourth stations. This is because a duration between image formations at the first, second, third, and fourth stations (about 400 ms) is shorter than a duration between the time when the contact/separation motor 31 is started and the time when image formation is performed at the first station (about 1350 ms). FIG. 20A illustrates a relation between the driving frequency of the contact/separation motor 31 and the correction amount of contact duration. At an identical driving frequency, the correction amounts for the second, third, and fourth stations are smaller than that for the first station. A method for determining the driving frequency of the contact/separation motor 31 in FIG. 20B will be described below with reference to FIGS. 18A, 18B, and 20A. With the first station, since the correction amount of contact duration is 80 ms, the driving frequency of the contact/separation motor 31 can be obtained as 1105 pps (approximate value) by assigning x=80 to formula (1) (for calculating the driving frequency of the first station) described in the first exemplary embodiment.

With the second, third, and fourth stations, the driving frequency of the contact/separation motor 31 can be obtained by assigning a correction amount for each station to x in formula (2) (for calculating the driving frequencies of the second, third, and fourth stations) described in the first exemplary embodiment. With the second station, the correction amount of contact duration is 40 ms, and the driving frequency is 1080 pps. With the third station, the correction amount of contact duration is 0 ms, and the driving frequency is 1200 pps. With the fourth station, the correction amount of contact duration is 80 ms, and the driving frequency is 960 pps.

The drive of contact/separation motor 31 in the present exemplary embodiment is controlled based on a driving frequency table (based on the two-phase excitation method) illustrated in FIG. 21. Specifically, when driving the contact/separation motor 31 from a stop state to 1200 pps, the excitation duration is sequentially changed as described for steps 0 to 60 in the driving frequency table illustrated in FIG. 21. Further, also when changing the driving speed, the driving frequency is changed step by step from a step before change to a step after change. The driving frequency table in FIG. 21 is predetermined in consideration of the acceleration torque so that the load side torque (torque for rotation+acceleration torque) does not exceed the motor torque performance. As long as the motor is driven at driving frequencies not exceeding the maximum driving frequency (1200 pps) at which it is operative, change in speed causes no torque problem.

Figure 22:
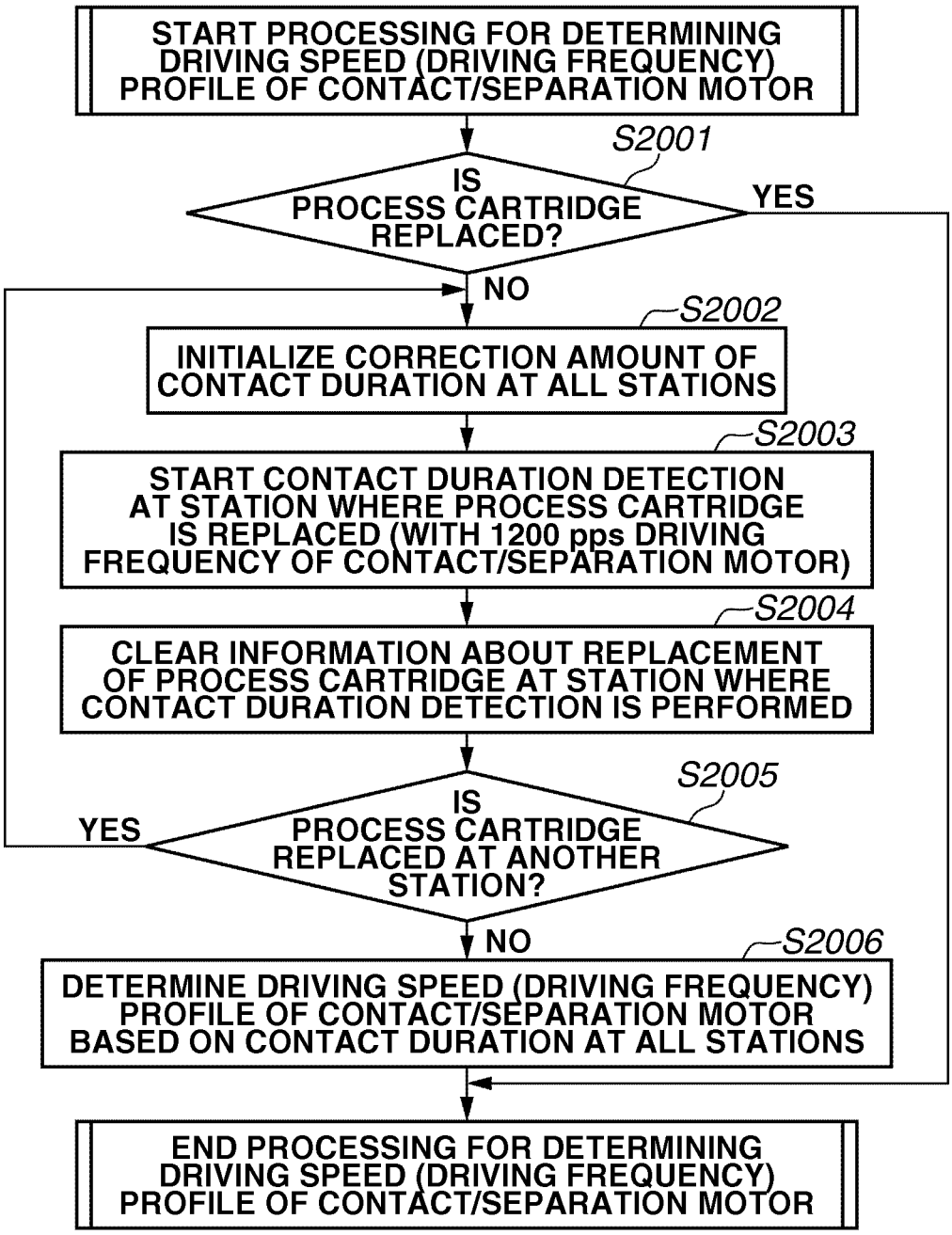
FIG. 22 is a flow chart illustrating a process for determining the driving frequency of the contact/separation motor based on a detected contact duration.

As operations of the image forming apparatus according to the present exemplary embodiment, processing flow from the step of detecting contact durations to the step of determining the driving frequency profile of the contact/separation motor 31 will be described below with reference to the flow chart of FIG. 22.

Since the duration of contact between the development roller 3 and the photosensitive drum 1 depends on the combination of image forming apparatus and process cartridges, the program, in step S2001, checks whether any process cartridge is replaced. When no process cartridge is replaced (NO in step S2001), the program terminates the processing. When a process cartridge is replaced (YES in step S2001), the program, in step S2002, initializes the correction amount of contact duration for the relevant station. In step S2003, the program detects a contact duration of the station where the process cartridge is replaced. The driving frequency of the contact/separation motor 31 at the time of contact duration detection is 1200 pps, which is the maximum driving speed as mentioned above.

In step S2004, the program clears the information about the replacement of process cartridge at the station that completed contact duration detection. In step S2005, the program checks whether a process cartridge is replaced at any other station. When a process cartridge is replaced at other stations (YES in step S2005), the program returns to step S2002. Otherwise (NO in step S2005), the program proceeds to step S2006 to determine a driving speed (driving frequency) profile of the contact/separation motor 31. Then, the program terminates the processing.

When contact duration detection is performed at the maximum driving speed of the contact/separation motor 31, the image forming apparatus is able to control the guaranteed contact duration to a suitable duration within the driving speed range by comparing contact durations of the four stations and decelerating the contact/separation motor 31. This control can optimize contact durations and hence reduce unnecessary contact durations without using a high-speed motor as the contact/separation motor 31. Accordingly, the image forming apparatus becomes able to alleviate the shortening of the lifetime of the development rollers 3 and photosensitive drums 1 without raising cost and specifications.

Figure 23:
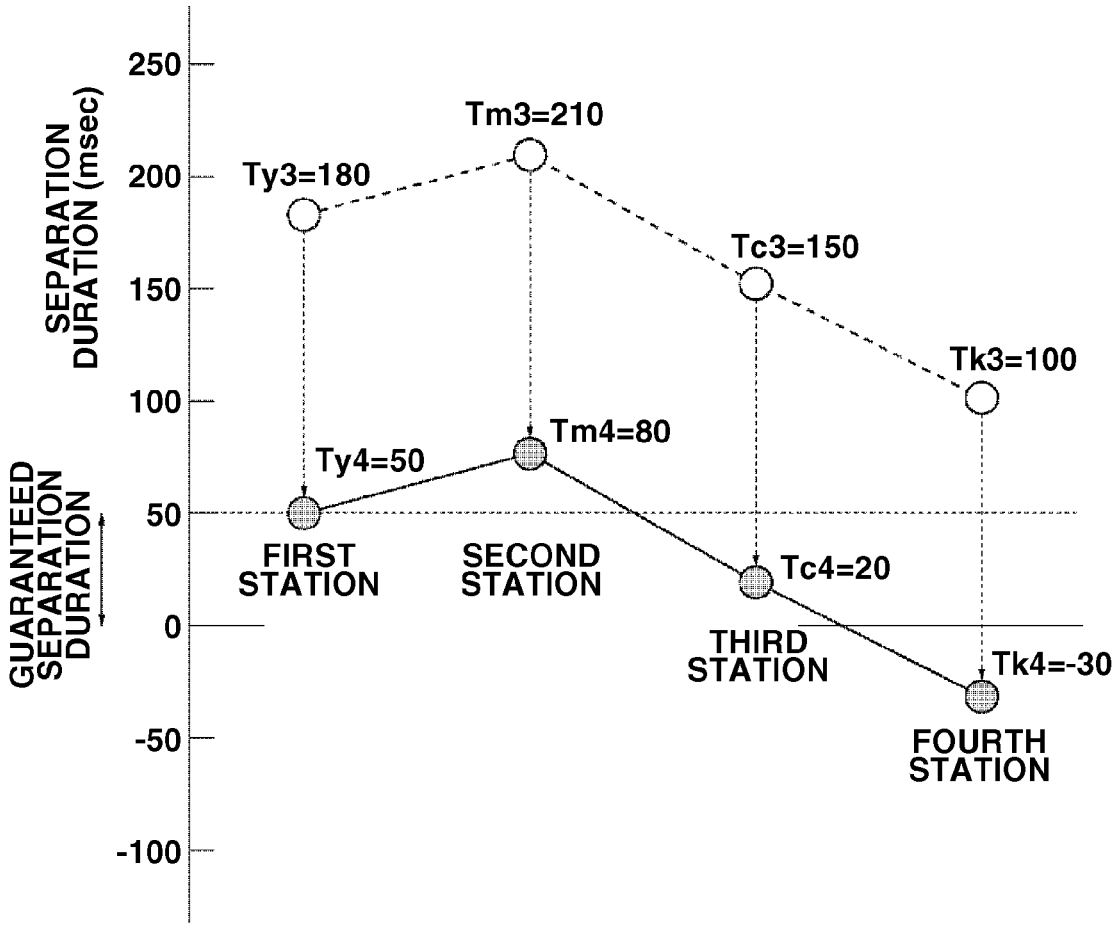
FIG. 23 illustrates a method for controlling the contact/separation motor to attain a separation duration suitable for each station.
Figure 24A:
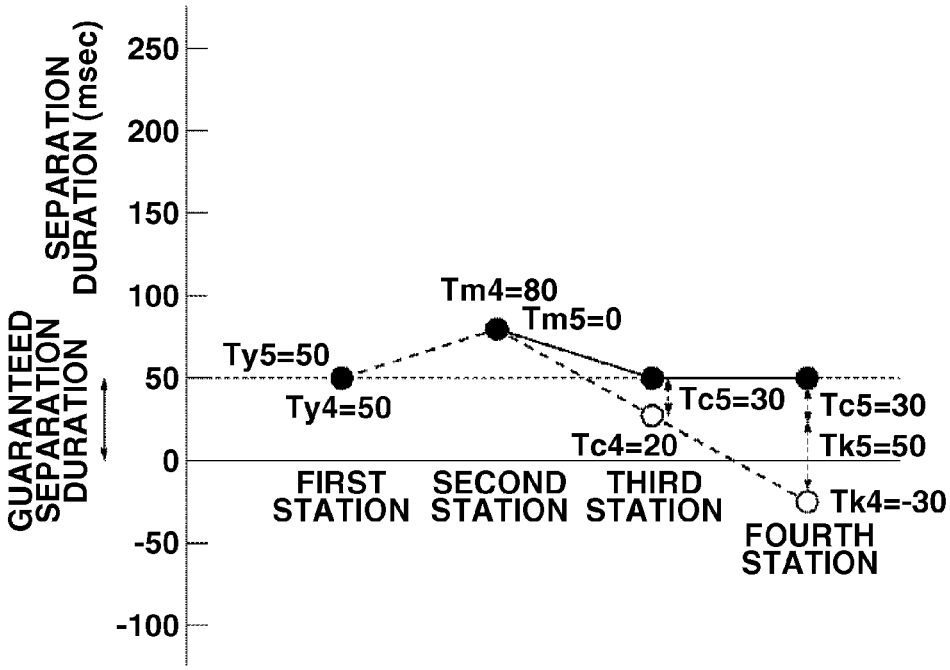
FIG. 24A illustrates a separation duration at each station.
Figure 24B:
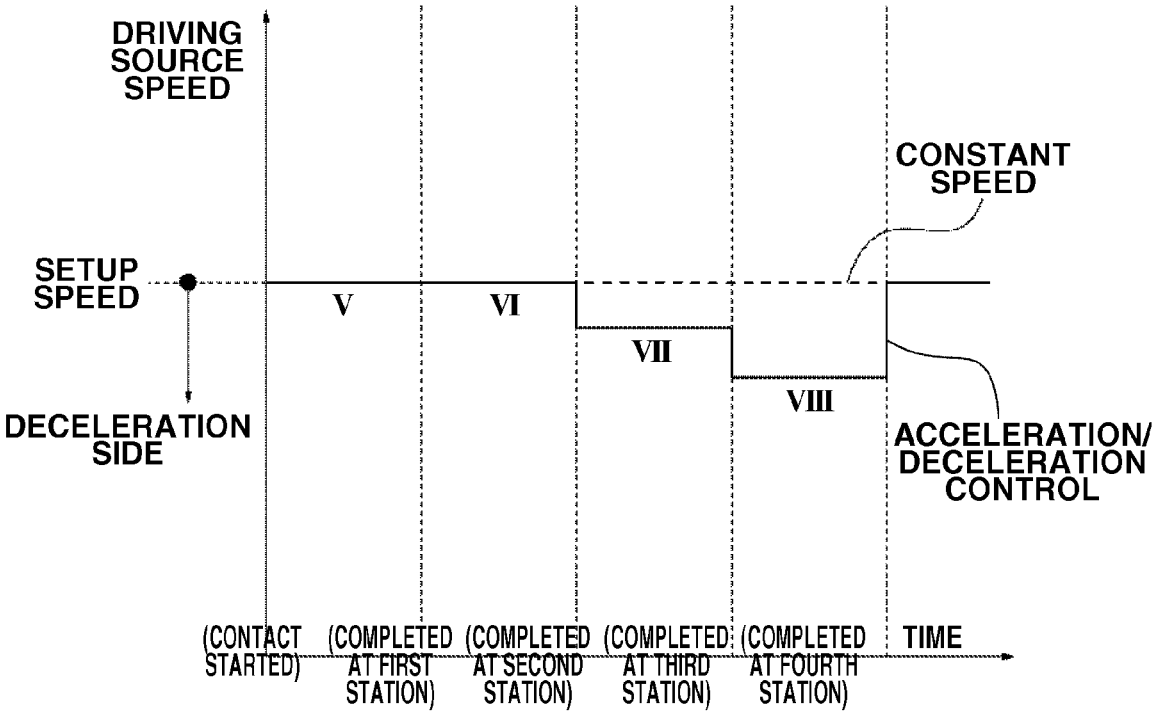
FIG. 24B illustrates acceleration/deceleration control for the contact/separation motor.

A method for controlling the driving speed of the contact/separation motor 31 to attain a separation duration suitable for each station based on the detected separation duration with reference to FIGS. 23, 24A, and 24B. Referring to the graph of FIG. 23, the dotted line denotes durations of separation between the development roller 3 and the photosensitive drum 1 when the contact/separation motor 31 is driven at a constant driving speed and separation timings are detected. Similar to the above-mentioned contact duration detection, the driving frequency of the contact/separation motor 31 at the time of separation timing detection is 1200 pps, and the maximum driving frequency at which it is operative is also 1200 pps. Therefore, the guaranteed separation duration (Y) is suitably controlled at driving speeds not exceeding the maximum driving frequency (1200 pps) of the contact/separation motor 31. Similar to the first exemplary embodiment, the guaranteed separation duration (Y) is 50 ms. However, when there is no influence of variation in control of the contact/separation motor 31, the guaranteed separation duration (Y) does not need to be provided. The length of the guaranteed separation duration (Y) can be suitably set in association with variation in control of the contact/separation motor 31.

Since the maximum driving speed of the contact/separation motor 31 cannot be accelerated more than the setup speed at the time of separation duration detection, separation durations cannot be made suitable through acceleration control. To suitably control separation durations by driving the contact/separation motor 31 at driving frequencies not exceeding the maximum driving frequency, the timing to start driving the contact/separation motor 31 is brought forward to attain a suitable separation duration of the first station as illustrated in FIG. 23. Bringing forward the timing to start driving in this way enables decelerating the contact/separation motor 31 to suitably control separation durations.

Referring to FIG. 24A, the dotted line denotes separation durations when the timing to start driving the contact/separation motor 31 is brought forward. With the first station, since the timing to start driving the contact/separation motor 31 is brought forward so that the separation duration of the first station coincides with the guaranteed separation duration (Y) allocated, the driving speed of the contact/separation motor 31 is matched with the setup speed as denoted by the solid line V in FIG. 24B. With the second station, since the separation time is longer than that of the first station, it is necessary to accelerate the contact/separation motor 31 to suitably control the separation duration. However, since it cannot be accelerated more than the setup speed, the driving speed of the contact/separation motor 31 is matched with the setup speed as denoted by the solid line VI in FIG. 24B. With the third station, since the separation duration is shorter than that of the second station, the driving speed of the contact/separation motor 31 is decelerated less than the setup speed during a duration between the time when contact is completed at the second station and the time when contact is completed at the third station as denoted by the solid line VII in FIG. 24B. With the fourth station, since the separation duration is shorter than that of the third station, the driving speed of the contact/separation motor 31 is decelerated less than the setup speed during a duration between the time when contact is completed at the third station and the time when contact is completed at the fourth station as denoted by the solid line VIII in FIG. 24B. The driving speed of the contact/separation motor 31 is controlled at each station in this way because it controls the drive of all of the stations as a single driving source.

A method for setting the driving speed of the contact/separation motor 31 at each station will be described below with reference to FIG. 23 and FIG. 24A. Separation durations of the four stations, Ty3, Tm3, Tc3, and Tk3, are as follows:

Ty3: 180 msec.

Tm3: 210 msec.

Tc3: 150 msec.

Tk3: 100 msec.

Since the guaranteed separation duration (Y) is set to 50 ms, the timing to start driving the contact/separation motor 31 is brought forward by 130 ms. Assuming that the guaranteed separation duration (Y) is 0 msec., corrected contact durations at the respective stations, Ty4, Tm4, Tc4, and Tk4, are as follows:

Ty4: 0 msec.

Tm4: 30 msec.

Tc4: −30 msec.

Tk4: −80 msec.

Since the contact/separation motor 31 drives all of the stations as a single driving source, correction amounts for preceding (upstream-side) stations are added to the result of correction at each station as follows:

Total correction amount for the first station: Ty3—"guaranteed separation duration (Y)"

Total correction amount for the second station: Ty3−Tm5

Total correction amount for the third station: Ty3−Tm5−Tc5

Total correction amount for the fourth station: Ty3−Tm5−Tc5−Tk5 Tm5, Tc5, are Tk5 represent the correction amounts of separation duration at the respective stations, which are obtained from the contact durations Tm4, Tc4, and Tk4 at the respective stations. The method for calculating the correction amounts Tm5, Tc5, are Tk5 is described below with reference to FIG. 25.

A method for controlling the separation duration at each station will be described below with reference to the above-mentioned relations and FIG. 24A. Firstly, the separation duration of the first station will be corrected. With the first station, since the timing to start driving the contact/separation motor 31 is brought forward, contact is established for 50 ms, which is the guaranteed separation duration (Y). This means that the contact/separation motor 31 is driven at the setup speed and therefore separation duration correction is not performed.

The separation duration of the second station will be corrected. With the second station, contact is established 30 ms longer than the guaranteed separation duration (Y). However, since the separation duration of the second station cannot be matched with the guaranteed separation duration (Y) by accelerating the contact/separation motor 31, it is driven at the setup speed and, therefore, separation duration correction is not performed.

The separation duration of the third station will be corrected. With the third station, since contact is established −30 ms shorter than the guaranteed separation duration (Y), the contact/separation motor 31 is decelerated to match the separation duration of the third station with the guaranteed separation duration (Y).

The separation duration of the fourth station will be corrected. With the fourth station, since contact is established −50 ms shorter than the guaranteed contact duration (X) due to separation duration correction at the third station, the contact/separation motor 31 is decelerated to match the separation duration of the fourth station separation with the guaranteed separation duration (Y).

Figure 25:
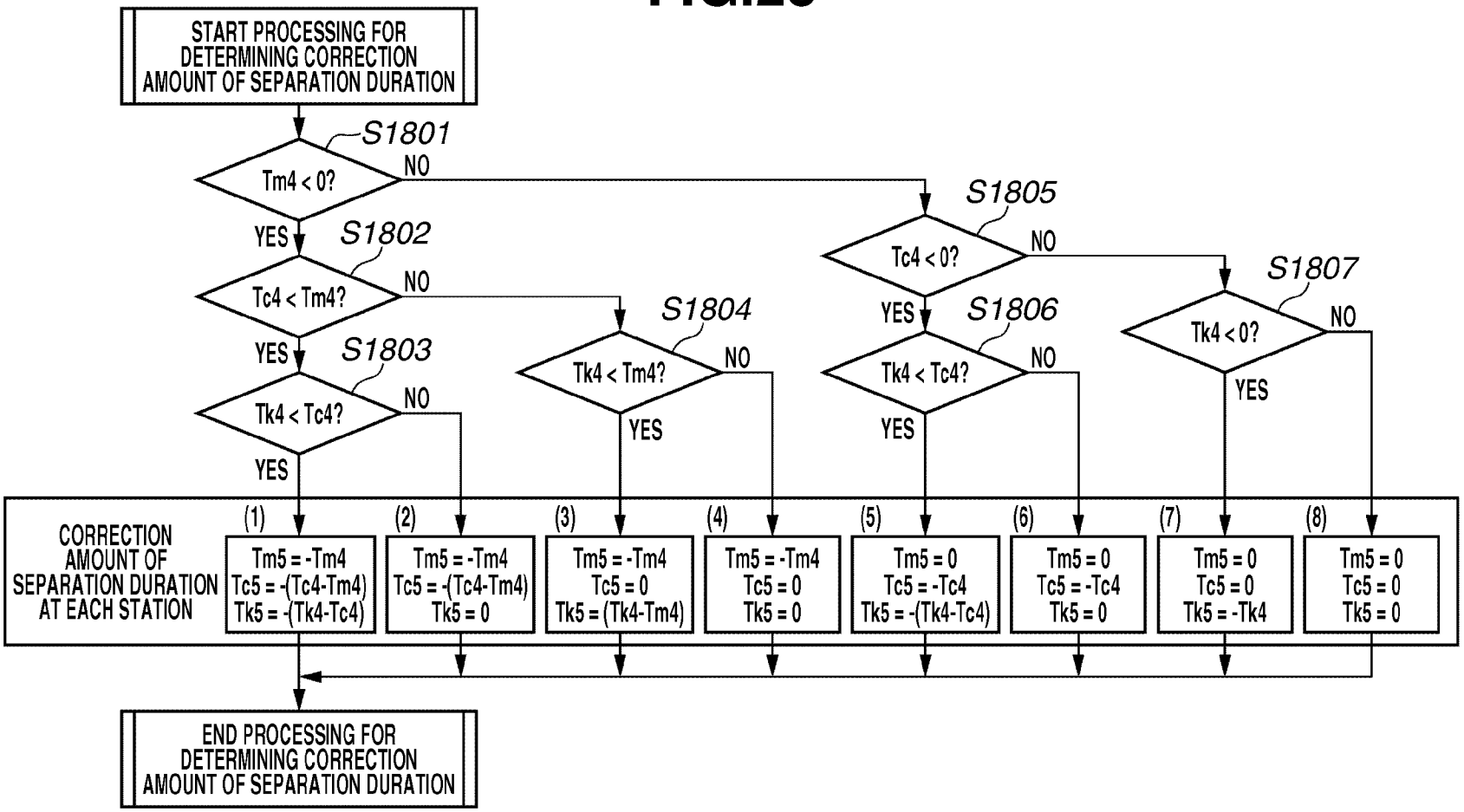
FIG. 25 is a flow chart illustrating a relation between a separation duration at each station and driving speed control for the contact/separation motor.

When the maximum driving speed of the contact/separation motor 31 is predetermined and the motor cannot be accelerated more than the setup speed in this way, separation durations of the four stations are compared and, separation durations are suitably controlled so that they do not become smaller than the guaranteed separation duration (Y). FIG. 25 is a flow chart illustrating a relation between the separation duration of each station and control of the driving speed of the contact/separation motor 31.

Referring to FIG. 25, in step S1801, the CPU 26 determines whether the duration Tm4 is less than 0. If the duration Tm4 is less than 0, the processing proceeds to step S1802. If the duration Tm4 is not less than 0, the processing proceeds to step S1805. In step S1802, the CPU 26 determines whether the duration Tc4 is less than the duration Tm4. If the duration Tc4 is less than the duration Tm4, the processing proceeds to step S1803. If the duration Tc4 is not less than the duration Tm4, the processing proceeds to step S1804. In step S1803, the CPU 26 determines whether the duration Tk4 is less than the duration Tc4. If the duration Tk4 is less than the duration Tc4, the CPU 26 sets the correction amounts of separation duration at the respective stations as Tm5=−Tm4, Tc5=−(Tc4−Tm4), and Tk5=−(Tk4−Tc4). If the duration Tk4 is not less than the duration Tc4, the CPU 26 sets the correction amounts of separation duration at the respective stations as Tm5=−Tm4, Tc5=−(Tc4−Tm4), and Tk5=0. In step S1804, the CPU 26 determines whether the duration Tk4 is less than the duration Tm4. If the duration Tk4 is less than the duration Tm4, the CPU 26 sets the correction amounts of separation duration at the respective stations as Tm5=−Tm4, Tc5=0, and Tk5=−(Tk4−Tm4). If the duration Tk4 is not less than the duration Tm4, the CPU 26 sets the correction amounts of separation duration at the respective stations as Tm5=−Tm4, Tc5=0, and Tk5=0.

In step S1805, the CPU 26 determines whether the duration Tc4 is less than 0. If the duration Tc4 is less than t0, the processing proceeds to step S1806. If the duration Tc4 is not less than 0, the processing proceeds to step S1807. In step S1806, the CPU 26 determines whether the duration Tk4 is less than the duration Tc4. If the duration Tk4 is less than the duration Tc4, the CPU 26 sets the correction amounts of separation duration at the respective stations as Tm5=0, Tc5=−Tc4, and Tk5=−(Tk4−Tc4). If the duration Tk4 is not less than the duration Tc4, the CPU 26 sets the correction amounts of separation duration at the respective stations as Tm5=0, Tc5=−Tc4, and Tk5=0. In step S1807, the CPU 26 determines whether the duration Tk4 is less than 0. If the duration Tk4 is less than 0, the CPU 26 sets the correction amounts of separation duration at the respective stations as Tm5=0, Tc5=0, and Tk5=−Tk4. If the duration Tk4 is not less than 0, the CPU 26 sets the correction amounts of separation duration at the respective stations as Tm5=0, Tc5=0, and Tk5=0.

Figure 26A:
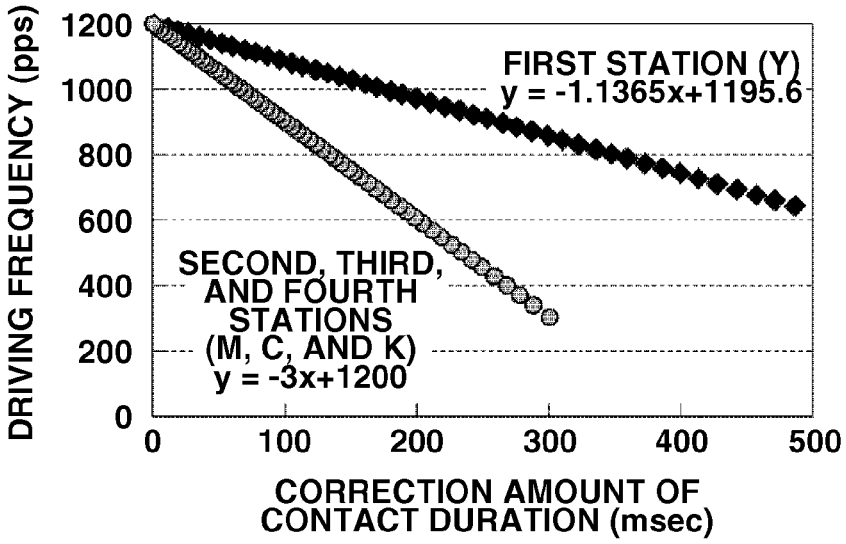
FIG. 26A illustrates a relation between the driving frequency of the contact/separation motor and the correction amount of separation duration.
Figure 26B:
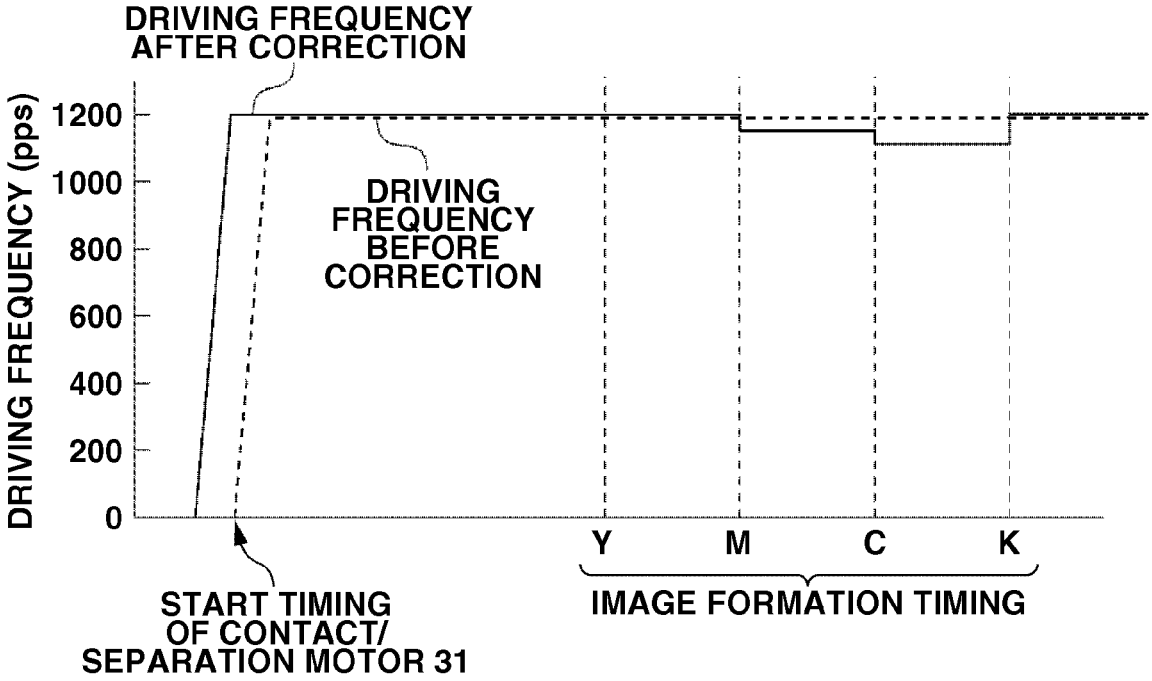
FIG. 26B illustrates the driving frequency with time.
Figure 27A:
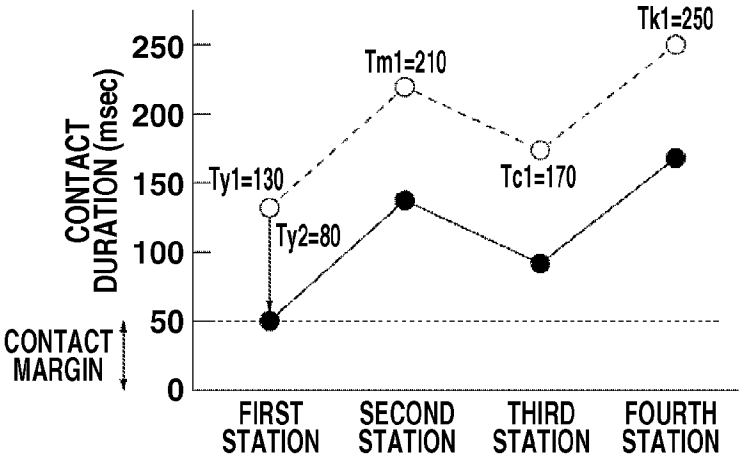
FIGS. 27A to 27D illustrate a method for correcting the contact duration at each station.
Figure 27B:
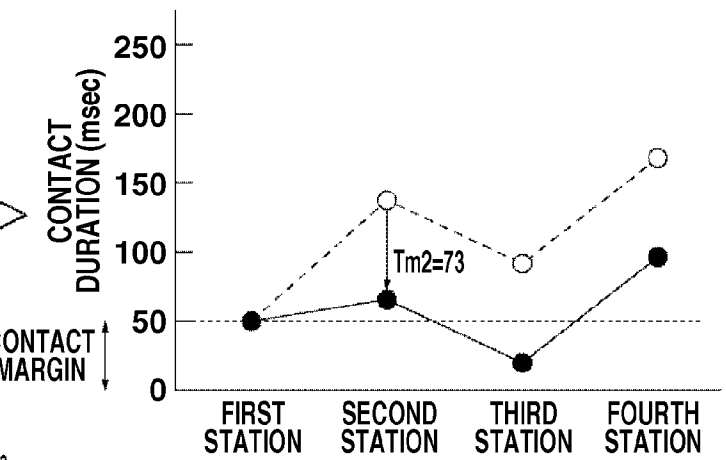
Figure 27C:
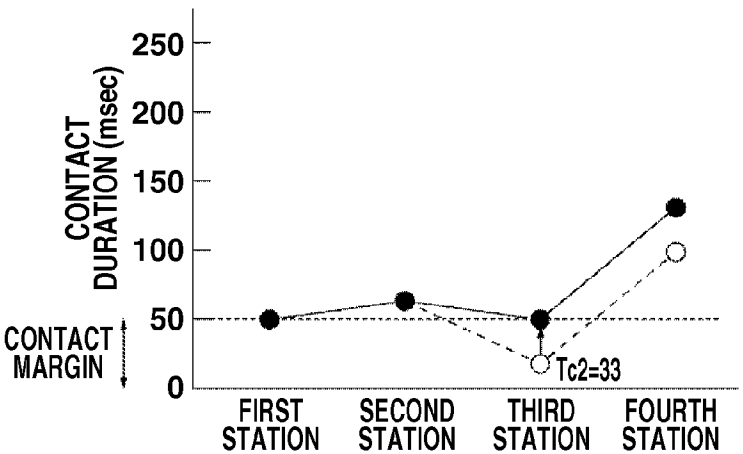
Figure 27D:
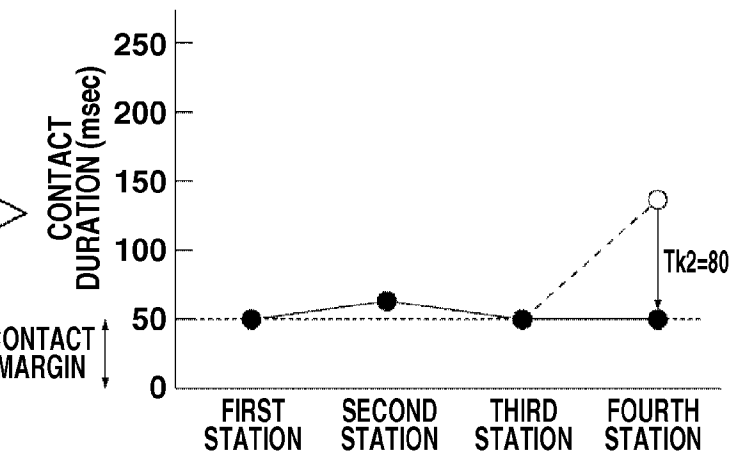

FIG. 26A illustrates a relation between the driving frequency of the contact/separation motor 31 and the correction amount of separation duration. Similar to the first exemplary embodiment, a relation between the driving frequency of the contact/separation motor 31 and the correction amount of contact duration differs between the first station and the second to fourth stations. This is because a duration between image formations at the first, second, third, and fourth stations (about 400 ms) is shorter than a duration between the time when the contact/separation motor 31 is started and the time when image formation is performed at the first station (about 1350 ms). FIG. 26A illustrates a relation between the driving frequency of the contact/separation motor 31 and the correction amount of separation duration. At an identical driving frequency, the correction amounts for the second, third, and fourth stations are smaller than that for the first station. A method for determining the driving frequency of the contact/separation motor 31 in FIG. 26B will be described below with reference to FIGS. 24A, 24B, and 26A. With the first station, the correction amount of separation duration is 0 ms, and the driving frequency is 1200 pps.

With the second, third, and fourth stations, the driving frequency of the contact/separation motor 31 can be obtained by assigning a correction amount for each station to x in formula (2) (for calculating the driving frequencies of the second, third, and fourth stations). With the second station, the correction amount of separation duration is 0 ms, and the driving frequency is 1200 pps. With the third station, the correction amount of separation duration is −30 ms, and the driving frequency is 1110 pps. With the fourth station, the correction amount of separation duration is −50 ms, and the driving frequency is 1050 pps.

When separation duration detection is performed at the specified maximum driving speed of the contact/separation motor 31, the image forming apparatus is able to control the guaranteed separation duration to a suitable duration within the driving speed range by comparing separation durations of the four stations and decelerating the contact/separation motor 31 by changing its driving timing. This control can optimize separation durations and hence reduce unnecessary separation durations without using a high-speed motor as the contact/separation motor 31. Accordingly, the image forming apparatus becomes able to alleviate the shortening of the lifetime of the development rollers 3 and photosensitive drums 1 without raising cost and specifications.

Although the present exemplary embodiment has specifically been described on the premise that the driving speed of the contact/separation motor 31 at the time of contact duration detection is the maximum driving speed, a correction method illustrated in FIGS. 27A to 27D is attained if the maximum driving speed of the contact/separation motor 31 is 1300 pps. This correction method differs from the correction method in FIG. 19 in that the contact/separation motor 31 can be accelerated allowing the contact duration of the second station to be brought close to a target value. Thus, correction of contact and separation durations can be optimally controlled in consideration of the contact duration of each cartridge and the characteristics of the contact/separation motor 31. Although descriptions have been made of a method for separately detecting and correcting contact and separation durations, the image forming apparatus is able to collectively correct contact and separation durations in a series of detection sequences.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2009-141391 filed Jun. 12, 2009 and No. 2010-024604 filed Feb. 5, 2010, which are hereby incorporated by reference herein in their entirety.

What is claimed is:

1. An image forming apparatus comprising:

a first image bearing member;

a second image bearing member;

a first development unit configured to contact the first image bearing member having a latent image formed thereon to develop the latent image; and a second development unit configured to contact the second image bearing member having a latent image formed thereon to develop the latent image;

a change-over unit capable of changing over between a state where the first image bearing member is separated from the first development unit and a state where the first image bearing member is in contact with the first development unit to enable developing the latent image, and is capable of changing over between a state where the second image bearing member is separated from the second development unit and a state where the second image bearing member is in contact with the second development unit to enable developing the latent image;

a detection unit configured to detect a first contact detection time from a time when the change-over unit starts to change the state where the first image bearing member is separated from the first development unit to a time when the change-over unit finishes changing the state to the state where the first image bearing member is in contact with the first development unit, and detect a second contact detection time from a time when the change-over unit starts to change the state where the second image bearing member is separated from the second development unit to a time when the change-over unit finishes changing the state to the state where the second image bearing member is in contact with the second development unit; and a control unit configured to control contact timing and/or contact speed between the first image bearing member and the first development unit according to the first contact detection time detected by the detection unit, wherein, after performing timing control for the first image bearing member and the first development unit, the control unit controls contact timing and/or contact speed between the second image bearing member and the second development unit according to the first and second contact detection times detected by the detection unit.

2. The image forming apparatus according to claim 1, further comprising:

a drive unit configured to cause the first image bearing member and the first development unit to contact and separate from each other and to cause the second image bearing member and the second development unit to contact and separate from each other, wherein the control unit accelerates or decelerates the driving unit according to the contact detection times detected by the detection unit to control contact timing and/or contact speed.

3. The image forming apparatus according to claim 1, wherein the drive unit is a single driving source.

4. The image forming apparatus according to claim 1, wherein the control unit drives the drive unit at a maximum driving speed to detect the first and second contact detection times via the detection unit.

5. The image forming apparatus according to claim 4, wherein the control unit controls contact timing and/or contact speed between the first image bearing member and the first development unit and contact timing and/or contact speed between the second image bearing member and the second development unit at driving speeds not exceeding the maximum driving speed of the drive unit.

6. The image forming apparatus according to claim 5, wherein the control unit controls contact timing and/or contact speed between the first image bearing member and the first development unit so that the second image bearing member does not come into contact with the second development unit earlier than predetermined timing.

7. The image forming apparatus according to claim 1, wherein the detection unit detects a toner pattern formed on a transfer member to detect the first and second contact detection times.

8. An image forming apparatus comprising:

a first image bearing member;

a second image bearing member;

a first development unit configured to contact the first image bearing member having a latent image formed thereon to develop the latent image; and a second development unit configured to contact the second image bearing member having a latent image formed thereon to develop the latent image, a change-over unit capable of changing over between a state where the first image bearing member is separated from the first development unit and a state where the first image bearing member is in contact with the first development unit to enable developing the latent image, and capable of changing over between a state where the second image bearing member is separated from the second development unit and a state where the second image bearing member is in contact with the second development unit to enable developing the latent image;

a detection unit configured to detect a first separation detection time from a time when the change-over unit starts to change the state where the first image bearing member is in contact with the first development unit to a time when the change-over unit finishes changing the state to the state where the first image bearing member is separated from the first development unit, and detect a second separation detection time from a time when the change-over unit starts to change the state where the second image bearing member is in contact with the second development unit to a time when the change-over unit finishes changing the state to the state where the second image bearing member is separated from the second development unit; and a control unit configured to control separation timing and/or separation speed between the first image bearing member and the first development unit according to the first separation detection time detected by the detection unit, wherein, after performing timing control for the first image bearing member and the first development unit, the control unit controls separation timing and/or separation speed between the second image bearing member and the second development unit according to the first and second separation detection times detected by the detection unit.

9. The image forming apparatus according to claim 8, further comprising:

a drive unit configured to cause the first image bearing member and the first development unit to contact and separate from each other and to cause the second image bearing member and the second development unit to contact and separate from each other, wherein the control unit accelerates or decelerates the driving unit according to the separation detection times detected by the detection unit to control separation timing and/or separation speed.

10. The image forming apparatus according to claim 8, wherein the drive unit is a single driving source.

11. The image forming apparatus according to claim 8, wherein the control unit drives the drive unit at a maximum driving speed to detect the first and second separation detection times via the detection unit.

12. The image forming apparatus according to claim 11, wherein the control unit controls separation timing and/or separation speed between the first image bearing member and the first development unit and separation timing and/or separation speed between the second image bearing member and the second development unit at driving speeds not exceeding the maximum driving speed of the drive unit.

13. The image forming apparatus according to claim 12, wherein the control unit controls separation timing and/or separation speed between the first image bearing member and the first development unit so that the second image bearing member is not separated from the second development unit earlier than predetermined timing.

14. The image forming apparatus according to claim 12, wherein the control unit accelerates timing to start the drive unit when controlling the separation timing between the first image bearing member and the first development unit and the separation timing between the second image bearing member and the second development unit.

15. The image forming apparatus according to claim 8, wherein the detection unit detects a toner pattern formed on a transfer member to detect the first and second separation detection times.

* * * * *